US012733708B2

(12) United States Patent
Pratt

(10) Patent No.: US 12,733,708 B2
(45) Date of Patent: Sep. 15, 2026

(54) RAPID-ENTRY SHOE

(71) Applicant: FAST IP, LLC, Vineyard, UT (US)

(72) Inventor: Michael Pratt, Alpine, UT (US)

(73) Assignee: FAST IP, LLC, Lindon, UT (US)

( * ) Notice: Subject to any disclaimer, the term of this patent is extended or adjusted under 35 U.S.C. 154(b) by 0 days.

(21) Appl. No.: 17/211,831

(22) Filed: Mar. 25, 2021

(65) Prior Publication Data

US 2021/0204645 A1 Jul. 8, 2021

Related U.S. Application Data

(63) Continuation of application No. 16/582,086, filed on Sep. 25, 2019, now Pat. No. 11,844,392, which is a continuation of application No. 15/693,195, filed on Aug. 31, 2017, now Pat. No. 10,555,578, which is a continuation of application No. 13/509,780, filed as application No. PCT/US2010/056608 on Nov. 12, 2010, now Pat. No. 9,877,542.

(60) Provisional application No. 61/260,621, filed on Nov. 12, 2009.

(51) Int. Cl.

| | |
|---|---|
| ***A43B 11/00*** | (2006.01) |
| ***A43B 3/24*** | (2006.01) |
| ***A43B 21/42*** | (2006.01) |
| ***A43C 11/00*** | (2006.01) |

(52) U.S. Cl.

CPC ..... *A43B 11/00* (2013.01); *A43B 3/248* (2013.01); *A43B 21/42* (2013.01); *A43C 11/008* (2013.01)

(58) Field of Classification Search

CPC ..... A43B 3/242; A43B 3/248; A43B 11/00; A43C 11/00; A43C 11/008

USPC ..... 36/50.1, 58.5, 58.6, 105

See application file for complete search history.

(56) References Cited

U.S. PATENT DOCUMENTS

| | | | |
|---|---|---|---|
| 287,312 | A | 10/1883 | Packard |
| 736,156 | A | 8/1903 | Roberts |
| 1,266,620 | A | 5/1918 | Peabody |
| 1,926,818 | A | 9/1933 | Rateliff |
| 2,083,390 | A | 6/1937 | Murena |
| 2,118,019 | A | 5/1938 | Benjafield |
| 2,297,594 | A | 9/1942 | Weinstat |
| 2,693,039 | A | 11/1954 | Balut |
| 3,014,288 | A | 12/1961 | Evans et al. |

(Continued)

FOREIGN PATENT DOCUMENTS

| | | | |
|---|---|---|---|
| CN | 101991227 | A | 3/2011 |
| CN | 107467775 | A | 12/2017 |

(Continued)

OTHER PUBLICATIONS

U.S. Appl. No. 62/186, 148, filed Jun. 29, 2015, Zahabian.

*Primary Examiner* — Sharon M Prange

(57) ABSTRACT

A rapid-entry shoe allows the shoe to be rapidly entered and readied for wearing by the user. The shoe may be any of a wide variety of shoe types, including shoes of a wide variety of styles and functions. The rapid entry features of the shoes utilize various movable elements that are attached to a sole portion or other portion of the shoe and allow movement of a portion of the shoe under pressure to allow rapid entry of the user's foot into the shoe. The moveable elements may include flexible elements, elements having constructed to have a memory of a native position, magnetic elements, and/or elastic elements.

11 Claims, 55 Drawing Sheets

(56) References Cited

U.S. PATENT DOCUMENTS 3,040,454 A 6/1962 Topper et al.
3,097,438 A 7/1963 Evans
3,192,651 A 7/1965 Smith
3,373,512 A 3/1968 Jacobson
3,643,350 A 2/1972 Paoletta et al.
3,798,802 A 3/1974 Saunders
4,596,080 A 6/1986 Benoit et al.
4,805,321 A 2/1989 Tonkel
4,924,605 A * 5/1990 Spademan ..... A43C 11/00 36/114
4,979,319 A 12/1990 Hayes
5,090,140 A 2/1992 Sessa
5,174,050 A 12/1992 Gabrielli
5,257,470 A 11/1993 Auger et al.
5,259,126 A 11/1993 Rosen
5,265,353 A 11/1993 Marega et al.
5,311,678 A * 5/1994 Spademan ..... A43B 5/00 36/114
5,353,526 A 10/1994 Foley et al.
5,430,961 A 7/1995 Faulconer et al.
5,806,208 A 9/1998 French
5,846,063 A 12/1998 Lakic
5,983,530 A * 11/1999 Chou ..... A43B 11/00 36/118.1
6,000,148 A 12/1999 Cretinon
6,014,823 A 1/2000 Lakic
6,128,837 A 10/2000 Huang
6,170,173 B1 1/2001 Caston
6,290,559 B1 9/2001 Scott
6,321,466 B1 11/2001 Bordin et al.
6,367,171 B1 4/2002 Burt
6,427,361 B1 * 8/2002 Chou ..... A43C 11/008 36/138
6,470,537 B1 10/2002 Schallenkamp
6,643,954 B2 * 11/2003 Voswinkel ..... A43B 21/42 36/138
6,839,985 B2 1/2005 Bettiol
6,877,252 B2 4/2005 Wilkinson
6,925,732 B1 8/2005 Clarke
7,059,068 B2 6/2006 Magallanes et al.
D583,956 S 12/2008 Chang et al.
7,757,414 B2 7/2010 Tonkel
8,302,329 B2 11/2012 Hurd et al.
8,333,021 B2 12/2012 Johnson
8,745,901 B2 6/2014 Toraya
9,119,441 B2 9/2015 Frappier
9,314,067 B2 * 4/2016 Bock ..... A43B 11/00
9,351,532 B2 5/2016 Mokos
9,629,416 B2 4/2017 Rackiewicz et al.
9,848,674 B2 * 12/2017 Smith ..... A43C 11/00
9,999,278 B2 6/2018 Feinstein
10,271,616 B2 * 4/2019 Labbe ..... A43C 11/165
10,327,515 B2 6/2019 Peyton et al.
10,499,707 B2 12/2019 Hobson et al.
10,506,842 B2 12/2019 Pratt et al.
10,568,382 B2 2/2020 Hatfield et al.
10,602,802 B2 * 3/2020 Hopkins ..... A43B 3/248
10,609,981 B1 4/2020 Phinney
10,617,174 B1 4/2020 Hopkins et al.
10,653,209 B2 5/2020 Pratt et al.
10,765,167 B2 9/2020 Azoulay et al.
10,791,796 B1 10/2020 Baker
10,813,405 B2 10/2020 Pratt
10,912,348 B2 2/2021 Owings et al.
10,973,278 B2 4/2021 Raia
11,140,941 B2 10/2021 Xanthos et al.
11,154,113 B2 10/2021 Hatfield et al.
11,172,727 B2 11/2021 Hatfield et al.
11,234,482 B2 2/2022 Roser
D948,190 S 4/2022 Jury
D948,191 S 4/2022 Holmes
D949,540 S 4/2022 Jury
D949,544 S 4/2022 Witherow
D955,732 S 6/2022 Kelley
11,633,016 B2 4/2023 Orand et al.
11,659,886 B2 5/2023 Cheney et al.
11,700,916 B2 7/2023 Kilgore et al.
11,707,113 B2 7/2023 Hopkins et al.
D993,601 S 8/2023 Wang et al.
11,737,511 B2 8/2023 Cheney et al.
11,744,319 B2 9/2023 Farina
2001/0001350 A1 5/2001 Aguerre
2002/0053147 A1 5/2002 Borsoi et al.
2002/0066213 A1 6/2002 Wells
2002/0095823 A1 7/2002 Laio et al.
2003/0106244 A1 6/2003 Miller et al.
2004/0003517 A1 1/2004 Marvin et al.
2004/0088890 A1 5/2004 Matis et al.
2004/0111921 A1 6/2004 Lenormand
2005/0034328 A1 2/2005 Geer
2005/0039348 A1 * 2/2005 Raluy ..... A43C 11/00 36/105
2005/0066543 A1 3/2005 Rosen et al.
2005/0198867 A1 * 9/2005 Labbe ..... A43C 11/14 36/50.1
2005/0241189 A1 11/2005 Elkington et al.
2007/0180730 A1 8/2007 Greene et al.
2007/0209234 A1 * 9/2007 Chou ..... A43B 11/00 36/138
2007/0256329 A1 11/2007 Antonelli et al.
2007/0271822 A1 11/2007 Meschter
2007/0277394 A1 12/2007 Hansen et al.
2008/0086911 A1 * 4/2008 Labbe ..... A43C 11/008 36/50.1
2008/0092406 A1 * 4/2008 Ludemann ..... A43B 17/18 36/43
2008/0276492 A1 11/2008 Burnett
2009/0090026 A1 4/2009 Mosher
2009/0223084 A1 * 9/2009 Kaufman ..... A43C 11/008 36/43
2010/0037483 A1 2/2010 Meschter et al.
2010/0095494 A1 4/2010 Martin
2010/0095554 A1 4/2010 Gillespie
2010/0251572 A1 10/2010 Baudouin et al.
2011/0185592 A1 8/2011 Nishiwaki et al.
2011/0214313 A1 9/2011 James et al.
2011/0239489 A1 10/2011 Iuchi et al.
2011/0277350 A1 11/2011 Huynh
2012/0055044 A1 3/2012 Dojan et al.
2012/0060395 A1 3/2012 Blevens et al.
2012/0151799 A1 6/2012 Weinreb
2012/0167413 A1 7/2012 Marvin et al.
2013/0160328 A1 6/2013 Hatfield et al.
2014/0202044 A1 7/2014 Adami et al.
2014/0298687 A1 10/2014 Flinterman et al.
2015/0013189 A1 1/2015 Hanak et al.
2015/0047223 A1 2/2015 Flinterman et al.
2016/0128429 A1 5/2016 Hatfield et al.
2016/0302530 A1 10/2016 Smith et al.
2017/0035148 A1 2/2017 Marvin et al.
2017/0360151 A1 12/2017 Pratt
2019/0307208 A1 10/2019 Corcoran-Tadd et al.
2020/0015544 A1 1/2020 Pratt
2020/0037703 A1 2/2020 Twist
2020/0046066 A1 2/2020 Difrancisco
2020/0085136 A1 3/2020 Pratt et al.
2020/0196703 A1 6/2020 Hopkins
2020/0196787 A1 6/2020 Dament et al.
2020/0205520 A1 7/2020 Kilgore
2020/0245797 A1 8/2020 Kim
2020/0305552 A1 10/2020 Cheney et al.
2020/0323308 A1 10/2020 Dubuisson
2020/0375319 A1 12/2020 Yang
2020/0383424 A1 12/2020 Hughes
2021/0030107 A1 2/2021 Pratt et al.
2021/0059351 A1 3/2021 Piacentini
2021/0068493 A1 3/2021 Pratt et al.
2021/0068494 A1 3/2021 Zahabian
2021/0068498 A1 3/2021 Cheney et al.
2021/0106094 A1 4/2021 Cheney
2021/0112911 A1 4/2021 Pratt et al.
2021/0145114 A1 5/2021 Kyle
2021/0186146 A1 6/2021 Erwin

(56) References Cited

U.S. PATENT DOCUMENTS

| | | | |
|---|---|---|---|
| 2021/0204642 | A1 | 7/2021 | Kyle |
| 2021/0204643 | A1 | 7/2021 | Kyle |
| 2021/0204644 | A1 | 7/2021 | Kyle |
| 2021/0227923 | A1 | 7/2021 | Love et al. |
| 2021/0282495 | A1 | 9/2021 | Davis et al. |
| 2021/0321718 | A1 | 10/2021 | Chang |
| 2021/0330033 | A1 | 10/2021 | Pratt et al. |
| 2021/0337922 | A1 | 11/2021 | Cheney |
| 2021/0345727 | A1 | 11/2021 | Raia |
| 2022/0142291 | A1 | 5/2022 | Cheney et al. |
| 2022/0287406 | A1 | 9/2022 | Cheney et al. |
| 2022/0287407 | A1 | 9/2022 | Cheney et al. |
| 2022/0354220 | A1 | 11/2022 | Cheney |
| 2022/0361627 | A1 | 11/2022 | Cheney et al. |
| 2022/0369758 | A1 | 11/2022 | Pratt |
| 2022/0378144 | A1 | 12/2022 | Pratt et al. |
| 2022/0400810 | A1 | 12/2022 | Cheney et al. |
| 2023/0030016 | A1 | 2/2023 | Pratt et al. |
| 2023/0033366 | A1 | 2/2023 | Farina |
| 2023/0035573 | A1 | 2/2023 | Bar |
| 2023/0052916 | A1 | 2/2023 | Bar |
| 2023/0055164 | A1 | 2/2023 | Cheney et al. |
| 2023/0081272 | A1 | 3/2023 | Pratt |
| 2023/0084256 | A1 | 3/2023 | Brilliant |
| 2023/0218033 | A1 | 7/2023 | Cheney |
| 2023/0225450 | A1 | 7/2023 | Cheney et al. |
| 2023/0263270 | A1 | 8/2023 | Jones |
| 2023/0276897 | A1 | 9/2023 | Cheney et al. |
| 2023/0284737 | A1 | 9/2023 | Bar |

FOREIGN PATENT DOCUMENTS

| | | | | |
|---|---|---|---|---|
| EP | 1952715 | A1 | 8/2008 | |
| EP | 3266327 | A1 | 1/2018 | |
| FR | 3066679 | A1 | 11/2018 | |
| JP | 11-127907 | A | 5/1999 | |
| JP | 2010-104416 | A | 5/2010 | |
| JP | 2013-510685 | A | 3/2013 | |
| JP | 2014-161721 | A | 9/2014 | |
| KR | 10-2005-0095542 | A | 9/2005 | |
| KR | 10-2009-0093548 | A | 9/2009 | |
| KR | 10-2009-0130804 | A | 12/2009 | |
| KR | 10-0936510 | B1 | 1/2010 | |
| NL | 2000762 | C1 | 1/2009 | |
| WO | WO-2007080205 | A1 * | 7/2007 | ..... A43B 11/02 |
| WO | 2009/154350 | A1 | 12/2009 | |
| WO | 2018/230961 | A1 | 12/2018 | |
| WO | 2019/215359 | A1 | 11/2019 | |
| WO | 2021/162569 | A1 | 8/2021 | |
| WO | 2022/221339 | A1 | 10/2022 | |
| WO | 2023/049414 | A1 | 3/2023 | |
| WO | 2023/064568 | A1 | 4/2023 | |

* cited by examiner

RAPID-ENTRY SHOE

CROSS-REFERENCE TO RELATED APPLICATIONS

This application is a continuation of, claims priority to and the benefit of U.S. Ser. No. 16/582,086 filed Sep. 25, 2019 and entitled RAPID-ENTRY SHOE. The '086 application is a continuation of, claims priority to and the benefit of U.S. Ser. No. 15/693,195 filed Aug. 31, 2017 and entitled RAPID-ENTRY SHOE, issued as U.S. Pat. No. 10,555,578. The '195 application is a continuation of, claims priority to and the benefit of U.S. Ser. No. 13/509,780 filed May 14, 2012 and entitled RAPID-ENTRY SHOE, issued as U.S. Pat. No. 9,877,542. The '780 application is a U.S. national phase filing under 35 U.S.C. § 371 of PCT/US2010/056608 filed Nov. 12, 2010 and entitled RAPID-ENTRY SHOE. PCT/US2010/056608 claims the benefit of U.S. Provisional Patent Application No. 61/260,621 filed Nov. 12, 2009 and entitled RAPID ENTRY SHOE. All of the aforementioned applications are incorporated herein by reference in their entireties.

TECHNICAL FIELD

The present invention relates to shoes, and more particularly to shoes providing features to enhance rapid entry of a user's foot into the shoes.

BACKGROUND ART

Shoes come in a wide variety of shapes, sizes, functionalities, and purposes. While it is relatively easy to remove many types of shoes, it may not be so simple to put all such shoes back on again. Instead, many shoes require several steps to put the shoes on, including lacing and tying the shoes, using other fasteners, or the like, and such steps may include loosening and/or untying shoes that were not properly loosened or untied the last time the shoes were worn.

SUMMARY OF THE INVENTION

Implementation of the invention provides a rapid-entry shoe that allows the shoe to be rapidly entered and readied for wearing by the user. Implementation of the invention may be practiced with a wide variety of shoe types, enabling use of the invention with shoes of a wide variety of styles and functions. The rapid-entry features of the shoes utilize various movable elements that are fixedly attached to a sole portion of the shoe and allow movement of a portion of the shoe under pressure to allow rapid entry of the user's foot into the shoe. The moveable elements may include flexible elements, elements constructed to have a memory of a native position and/or elastic elements. The rapid-entry features of the shoes may also ease use of the shoes and/or ease putting on and/or taking off of the shoes.

BRIEF DESCRIPTION OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Figure 1:
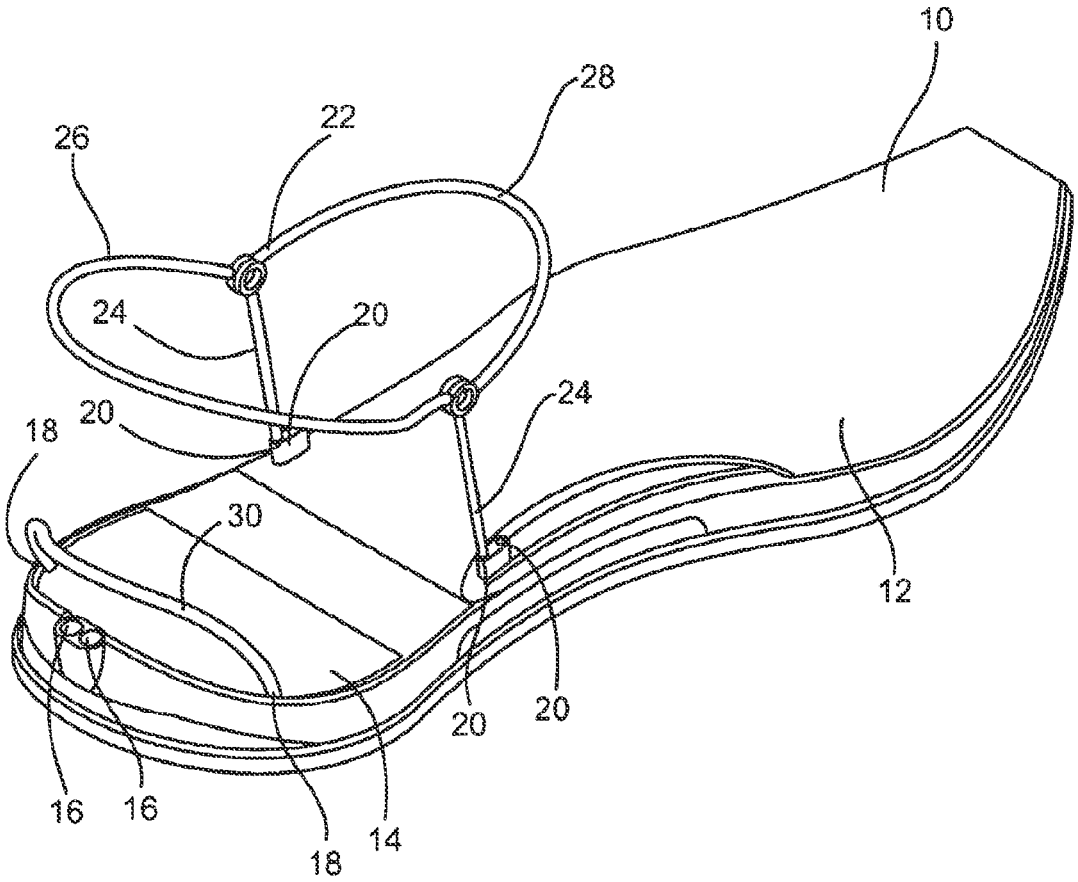
FIGS. 1-4 show various cutaway views of one embodiment of a shoe.
Figure 2:
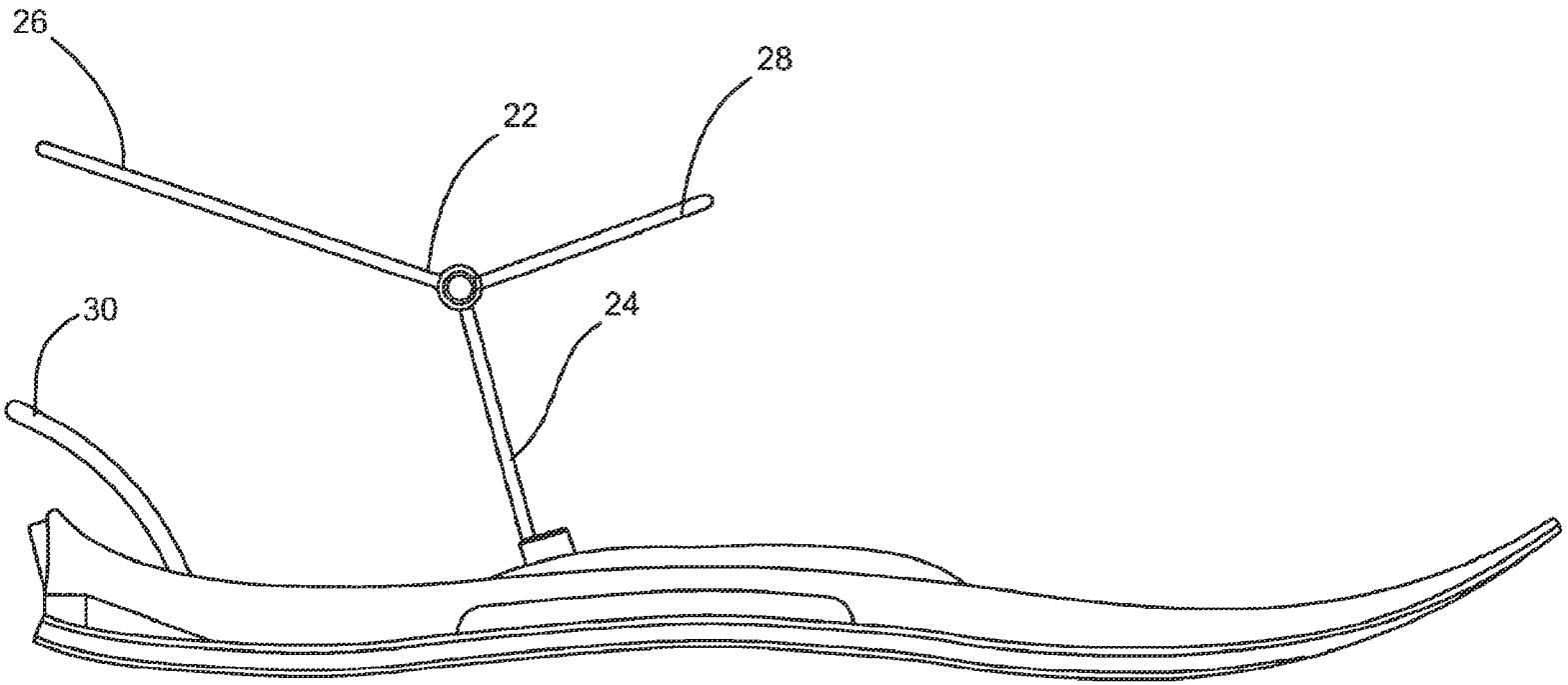

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Embodiments of the invention provide a rapid-entry shoe that allows the shoe to be rapidly and easily entered and readied for wearing by the user. Embodiments of the invention encompass a wide variety of shoe types, enabling use of the invention with shoes of a wide variety of styles and functions. Such functions include many of the functions currently provided by such shoes, and some embodiments of the invention allow for rapid entry of the shoe without an accompanying loss of the shoe's other functionalities. The rapid entry features of the shoes utilize various movable elements that are fixedly attached to a sole portion of the shoe and allow movement of a portion of the shoe under pressure to allow rapid entry of the user's foot into the shoe. The moveable elements may include flexible elements, elements constructed to have a memory of a native position and/or elastic elements. The rapid-entry features of the shoes may also ease use of the shoes and/or ease putting on and/or taking off of the shoes.

FIGS. 1-4 show various views of one embodiment of the invention, highlighting some of the functionality provided by embodiments of the invention. In these Figures, much of the foot-surrounding upper structure of the shoe has been omitted for clarity in illustration and understanding of the embodiments of the invention, which is also the case with many of the other Figures discussed below. Additionally, features of the lower sole of the shoes illustrated in the Figures, such as various patterns of tread, heel structure, and the like have also been omitted. It should be understood that the structures illustrated in the Figures can be used in a wide variety of shoes and configurations, including sandals, closed shoes, shoes with varying heights of heels, sports shoes of many types, dress shoes, and the like. Therefore, the Figures are intended to be merely illustrative of features of some embodiments of the invention, and are not intended to be limiting of the scope of the invention as claimed.

Some embodiments illustrated in the Figures utilize a common underlying structure, which will be discussed herein. The use of the common structure illustrates several features of the invention and illustrates that a common structure may be utilized to provide a platform for a wide variety of rapid-entry shoe styles and functionalities of the type discussed herein. In at least some embodiments, aspects of the common structure discussed herein remain unused and/or are not needed to provide the functionality discussed with respect to particular embodiments. As such, it should be understood that in such embodiments the unused portion of the common structure could be omitted without adversely affecting the functionality of the remaining structure. Additionally, where the specifically-illustrated structure is used, it should also be understood that structures other than those specifically illustrated may be used in place of the specifically-illustrated structures to provide similar functions. As the unused portions of the common structure vary from embodiment to embodiment, it will be understood that the illustrated structures, including the common structures, are intended to be merely illustrative of specific embodiments of the invention. In the Figures, only one shoe (either a left shoe or a right shoe) is illustrated. It is understood that the illustrated structure may be mirror-imaged to fit the opposite foot.

In FIG. 1, a sole support 10 is illustrated. The sole support 10 serves to support a sole portion of a user's foot when the user is wearing the shoe. As such, the sole support 10 includes a ball portion 12 and a heel portion 14. The sole support 10 may be formed of substantially one material, or it may be manufactured or formed from multiple layers that may include multiple materials. The sole support 10 may include or be formed from materials that serve to provide support and cushioning to the user's foot, as is known in the art.

Additionally, the sole support 10 serves to provide a variety of connection points for various rapid-entry structures. Some of the connection points are visible in FIG. 1, while others are more clearly visible and illustrated in other Figures. The connection points may be manufactured or formed from materials designed to provide sufficient strength to the rapid-entry structures discussed herein, and are generally dispersed around a periphery of the sole support 10 so as to maximize comfort of the wearer and to avoid interfering with the cushioning and support functions of the sole support 10. The connection points may include structures contiguously extending into an inner layer of the sole support 10, so as to increase the strength of the connection points.

The connection points may include one or more rear connection points 16 (illustrated as two closely-spaced rear connection points 16 in FIG. 1), one or more rear lateral connection points 18 (illustrated as one rear lateral connection point 18 on each side of the heel portion 14 in FIG. 1), and one or more front connection points 20 (illustrated as two closely-spaced front connection points 20 in FIG. 1). These connection points are used in varying ways in the certain different embodiments of the invention, as will be discussed below. In the embodiment illustrated in FIGS. 1-4, the rear lateral connection points 18 are optionally utilized, along with one of the front connection points 20 on each side of the shoe.

The front connection points 20 support a paddle loop 22 on a pair of supporting stalks 24. The paddle loop 22 includes a rear portion 26 and a front portion 28. In some embodiments, the front portion 28 may be omitted. The rear lateral connection points 18 in the illustrated embodiment support an optional rear support member 30. The rear support member 30 provides additional support to certain styles of shoe when present. When the shoe is finished, one of several scenarios may exist. In a first example, a flexible to semi-flexible material is disposed between the rear portion 26 of the paddle loop 22 and the lower back of the shoe. In a second example, a flexible to semi-flexible material is disposed between the rear portion 26 of the paddle loop 22 and the rear support member 30. In a third example (such as a sandal-style shoe), a gap is provided in the finished shoe between the rear portion 26 of the paddle loop 22 and either the lower back of the shoe or the rear support member.

Figure 3:
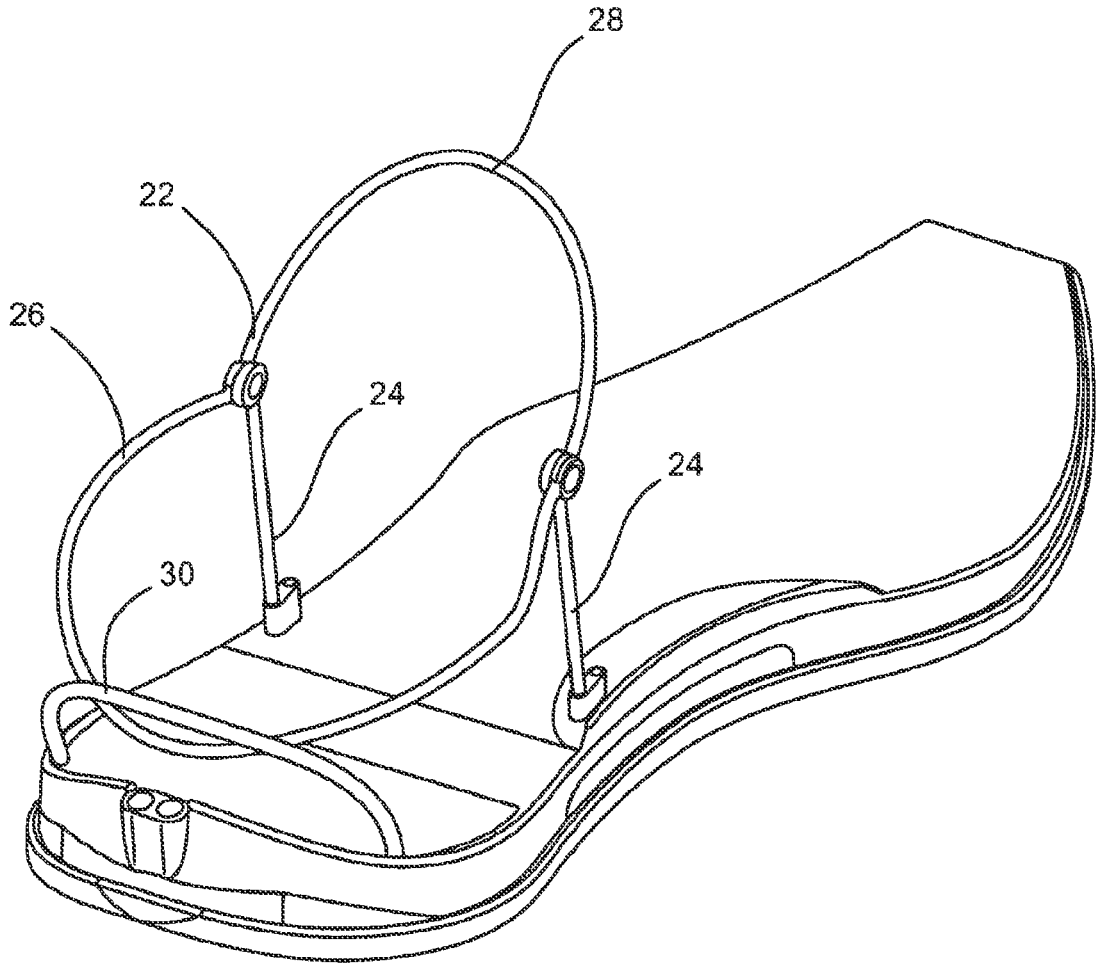
Figure 4:
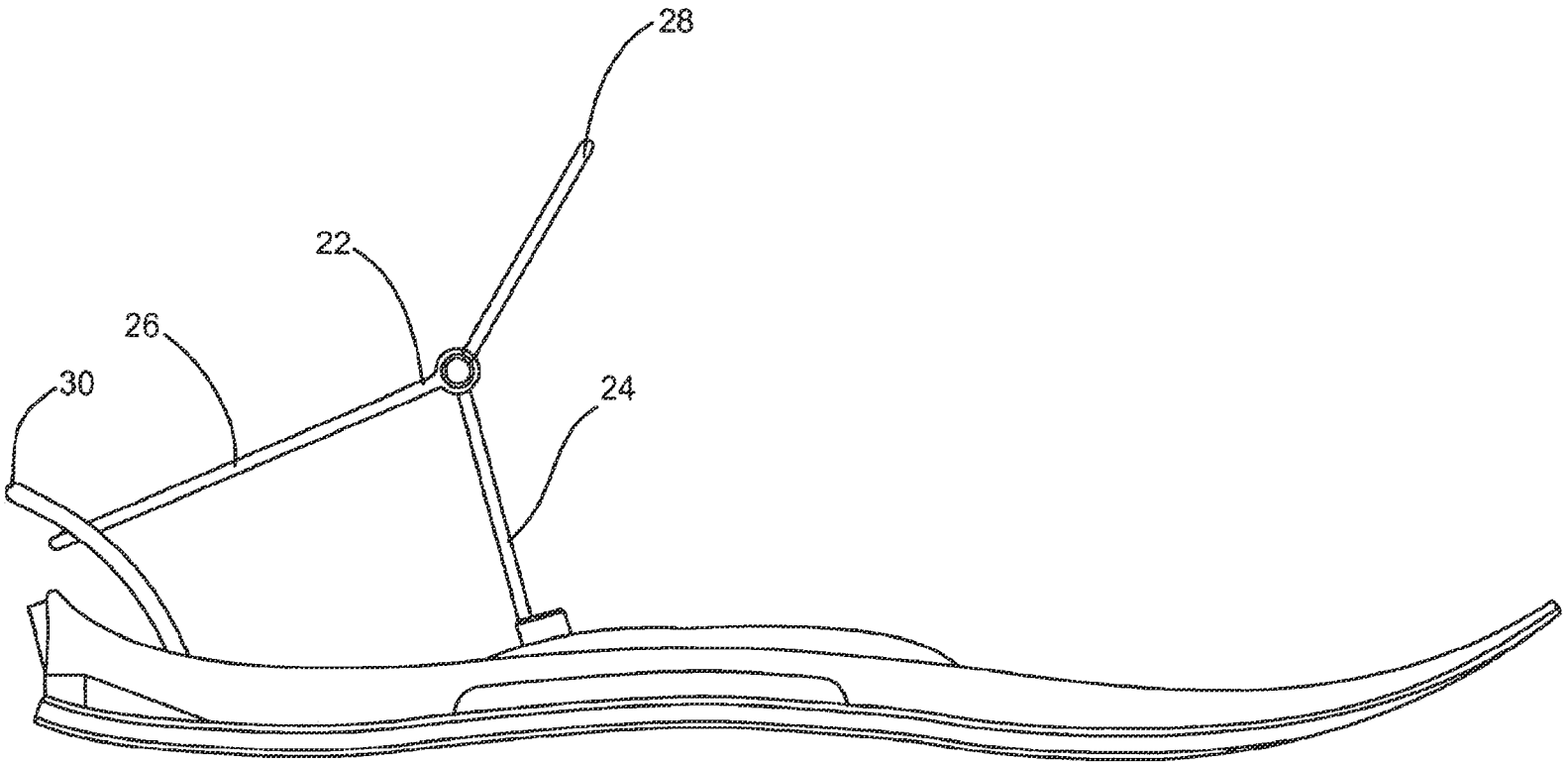

Regardless of the finished shoe type or example used, the paddle loop 22 provides for rapid entry into the shoe. In its resting or closed position, the paddle loop 22 naturally assumes the position shown in FIGS. 1 and 2, such as due to spring-type forces built into the paddle loop 22 and/or due to memory of the material from which the paddle loop 22 is constructed. When the user wishes to enter the shoe, the user pushes down on the rear portion 26 of the paddle loop 22 with his or her foot, which causes the paddle loop 22 to be displaced into the position shown in FIGS. 3 and 4. In actuality, the user typically does not push down on the rear portion 26 of the paddle loop 22 directly, but instead pushes down on a rear portion of the shoe structure encompassing the paddle loop 22. This movement of the paddle loop 22 is facilitated by the flexible to semi-flexible material or by the gap in the shoe below the rear portion 26, as discussed above. As best seen in FIGS. 3 and 4, the rear portion 26 of the paddle loop 22 passes in front of the rear support member 30, allowing maximum movement of the paddle loop 22 even when the rear support member 30 is present.

The downward motion of the rear portion 26 of the paddle loop 22 causes a corresponding upward movement of the front portion 28 of the paddle loop 22 in the embodiment of FIGS. 1-4. In other embodiments, the front portion 28 may remain essentially motionless for any of a variety of reasons, including a separation included between the front portion 28 and the rear portion 26, or due to constraints on the front portion 28 in the other structures of the shoe. Regardless of the motion or lack thereof of the front portion 28, the net effect of the movement of the paddle loop 22 causes the shoe to open substantially, thereby facilitating rapid entry of the user's foot into the shoe. Entry may be accomplished in a single motion, with the user essentially simultaneously pushing down on the rear portion 26 and sliding his or her foot into the shoe. Once the user's foot has entered the shoe completely or nearly completely, the back of the user's heel passes in front of the rearmost segment of the rear portion 26, thereby removing the downward force on the rear portion 26, which then naturally returns to its rest state shown in FIGS. 1 and 2. The result is that the user is then wearing the shoe.

Figure 5:
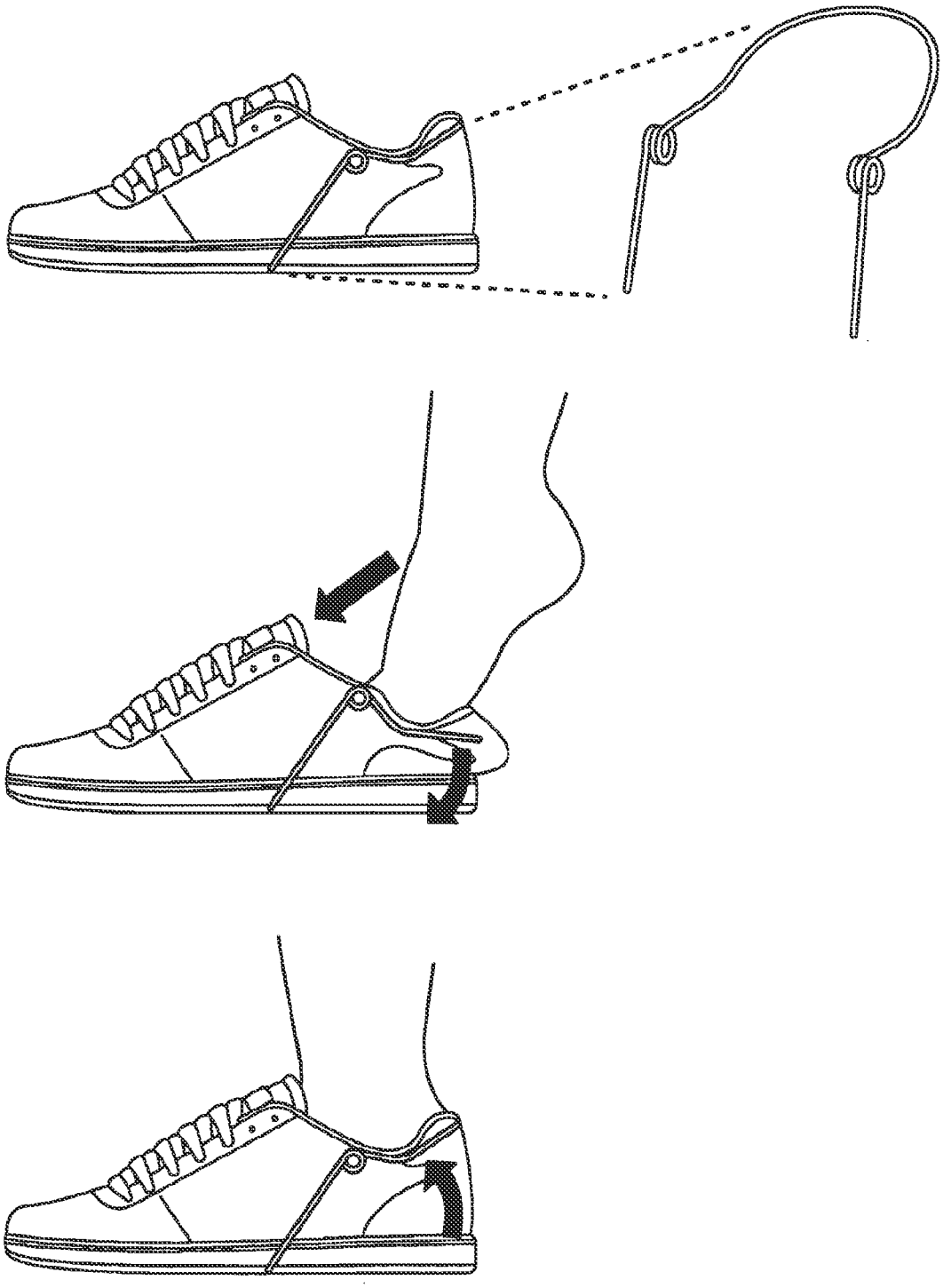
FIG. 5 shows an embodiment similar to the embodiment of FIGS. 1-4 and 6-8 and illustrates steps in using the embodiment.

FIG. 5 shows the steps in this process for a completed shoe incorporating features similar to those discussed above and illustrated in more detail in FIGS. 6-8. To remove the shoe, the same process is essentially repeated, but instead of the foot that is wearing the shoe pushing down on the rear portion 26 of the paddle loop 22, an external object is used to push down on the rear portion 26 so the user can remove his or her foot. The external object may be any object, including the user's hand, the user's other foot, or some other object. It should be appreciated that the rapid-entry features of these embodiments facilitate putting on and taking off shoes without needing to bend over to adjust the shoes. Thus, embodiments of the invention may provide for rapid entry (and also exit) of the shoe and may further provide improvements of ease of use for some users, especially those less able to bend over when putting shoes on or off.

Furthermore, as may be appreciated with respect to FIG. 5, embodiments of the invention may be used with shoes having certain adjustment features such as laces or other fasteners permitting the user to adjust the tightness of the shoes. Thus, a user might adjust a shoe incorporating features of embodiments of the present invention to a desired tightness using laces or other tightening mechanisms such as straps, hook-and-loop fasteners, hooks, snaps, buckles, or any other tightening mechanisms known in the art. Thereafter, the user may elect to utilize the rapid-entry features of embodiments of the present invention to thereafter enter and/or exit the shoe without affecting the tightness of the fit earlier selected. A shoe incorporating features of embodiments of the present invention may be kept significantly tighter in use than similar shoes without features of embodiments of the invention, while still allowing the shoe to be readily slipped on and off.

Figure 6:
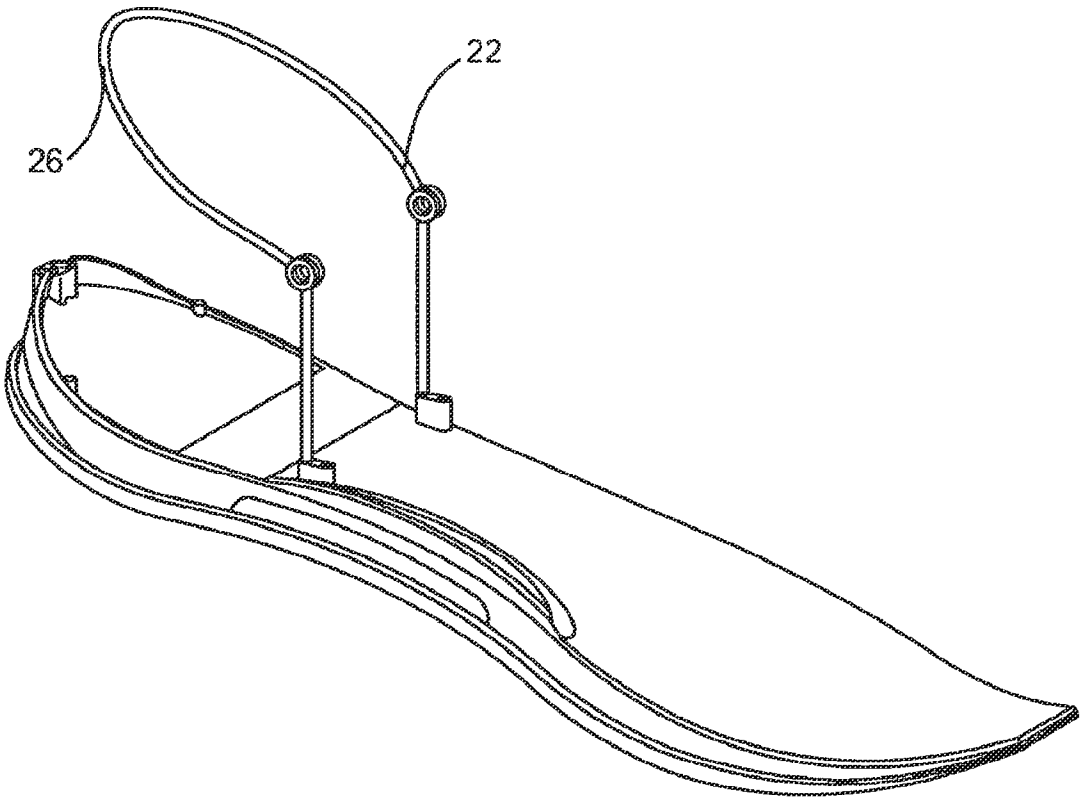
FIGS. 6-8 show various cutaway views of another embodiment of a shoe.
Figure 7:
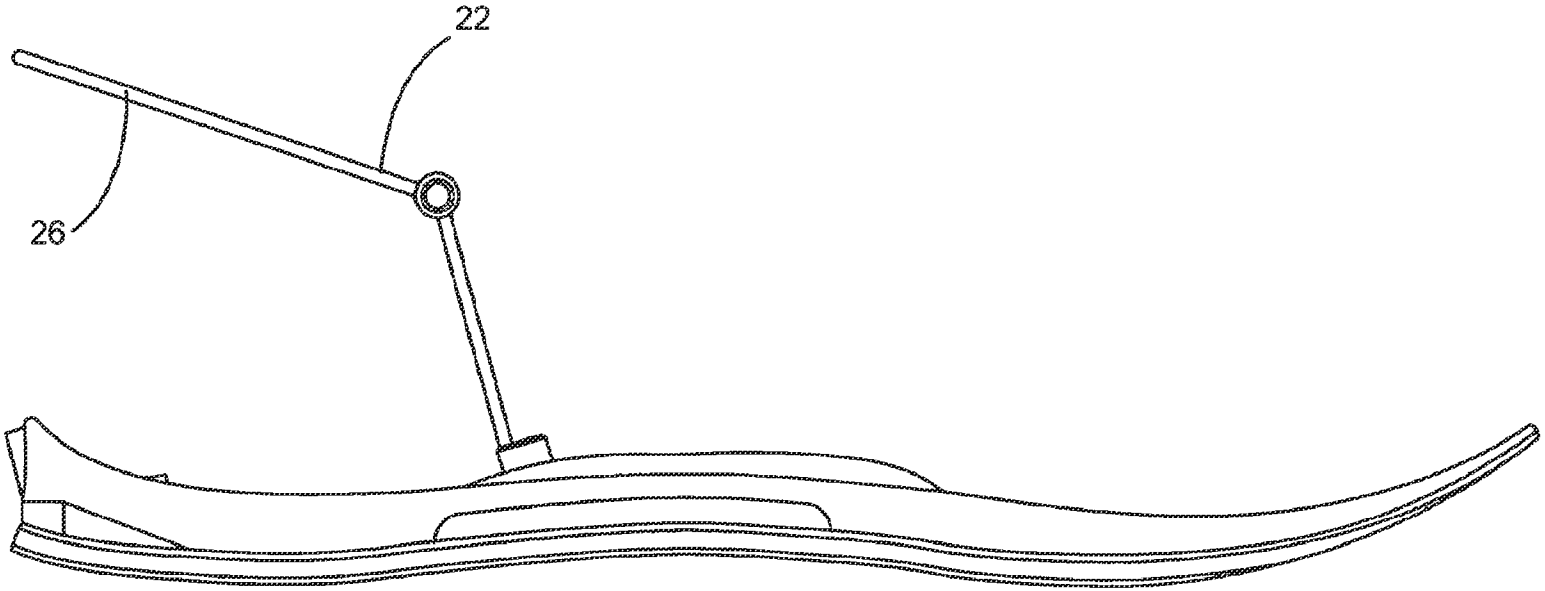
Figure 8:
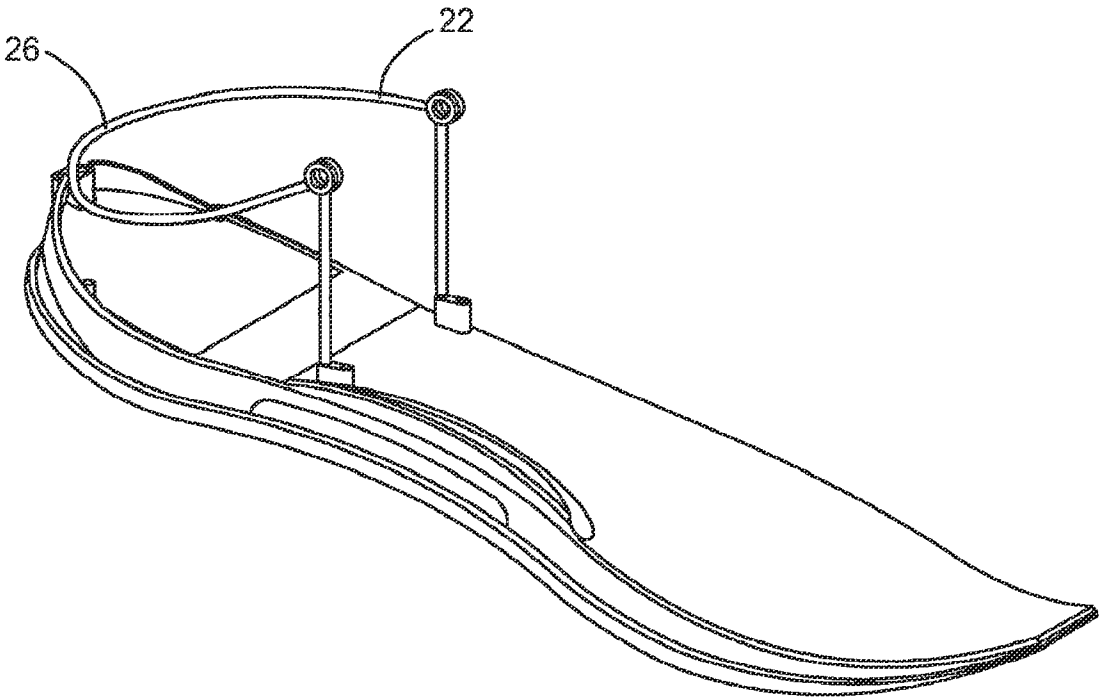

In the embodiment illustrated in FIGS. 6-8, only the rear portion 26 of the paddle loop 22 is present, and the rear support member 30 has been omitted. Otherwise, the function of this embodiment is similar to the functions described above in detail with respect to the embodiments discussed with respect to FIGS. 1-4.

FIGS. 9-11 and FIGS. 24-29 illustrate two embodiments that utilize only the rear connection points 16 and the rear lateral connection points 18. In these embodiments, the front connection points 20 are unused. Of course, the front connection points 20 may be used by other structures in the shoe not specifically illustrated in these Figures.

Figure 9:
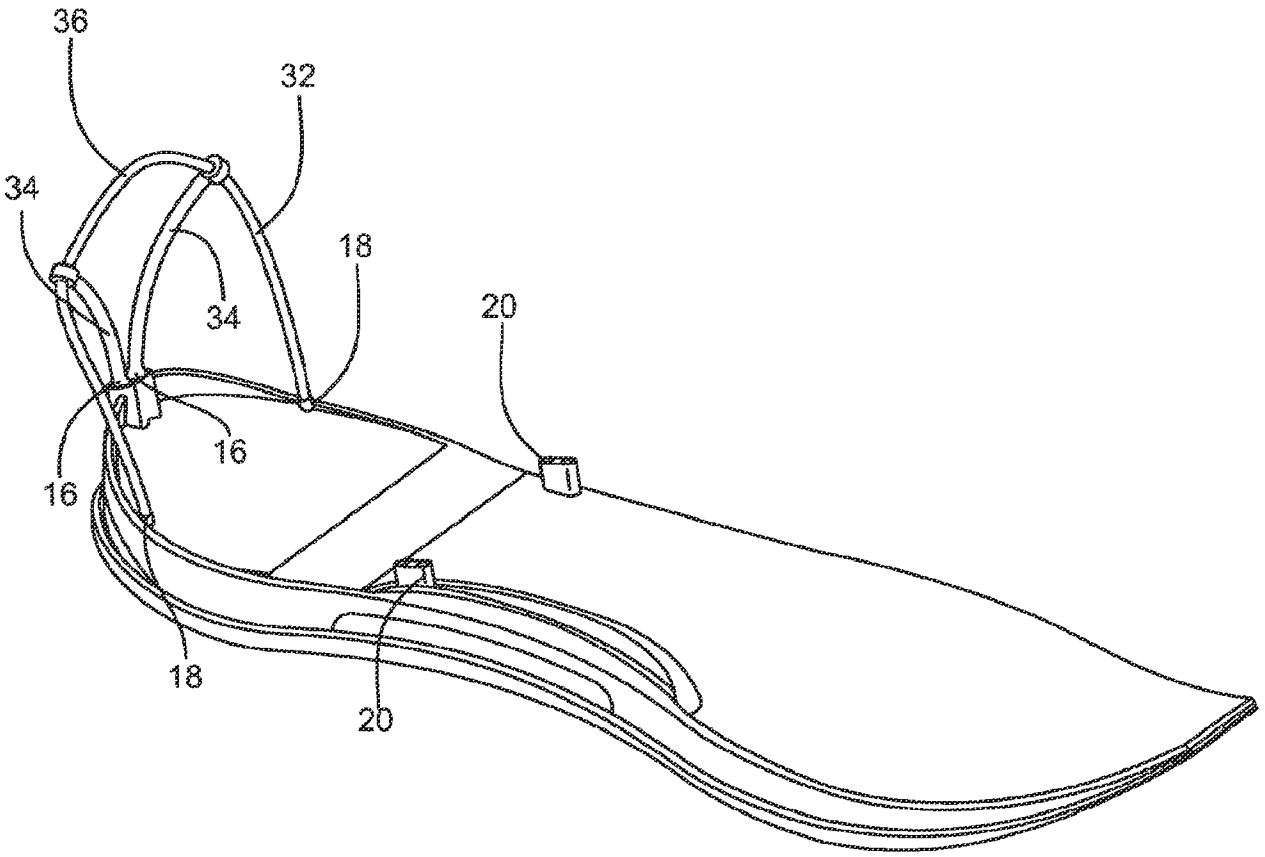
FIGS. 9-11 show various cutaway views of another embodiment of a shoe.
Figure 10:
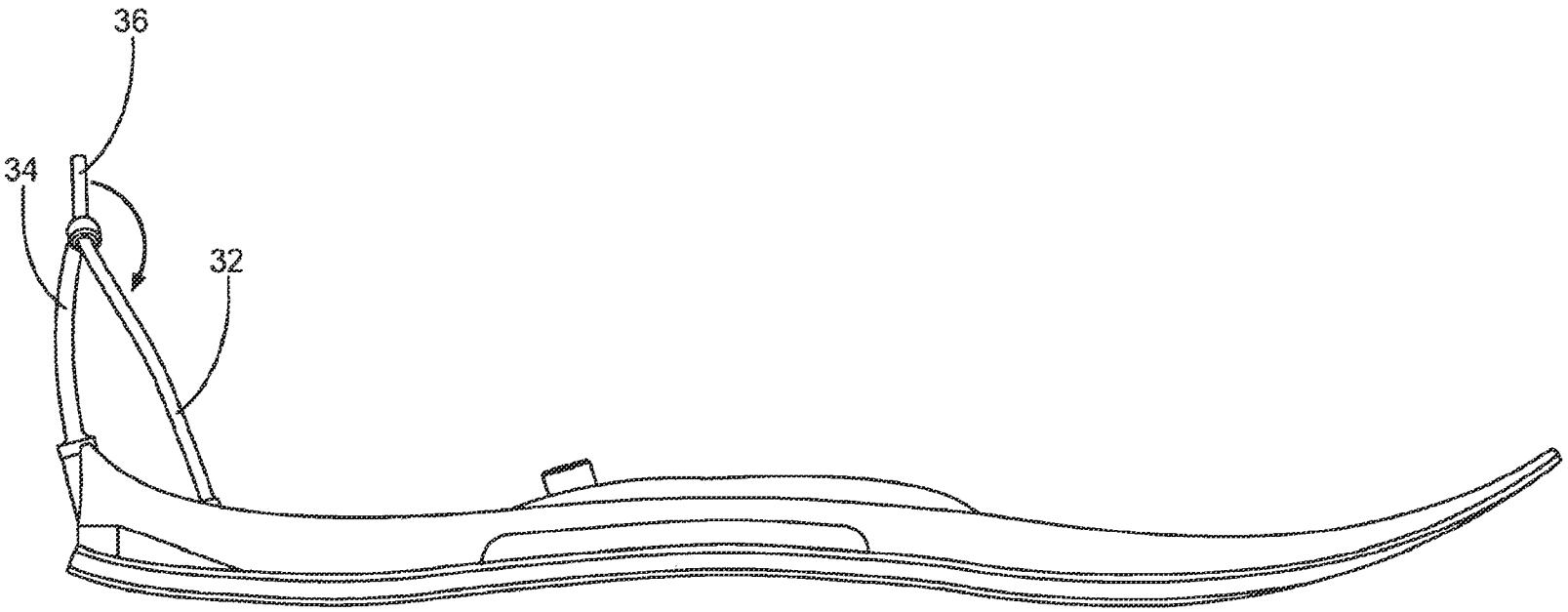
Figure 11:
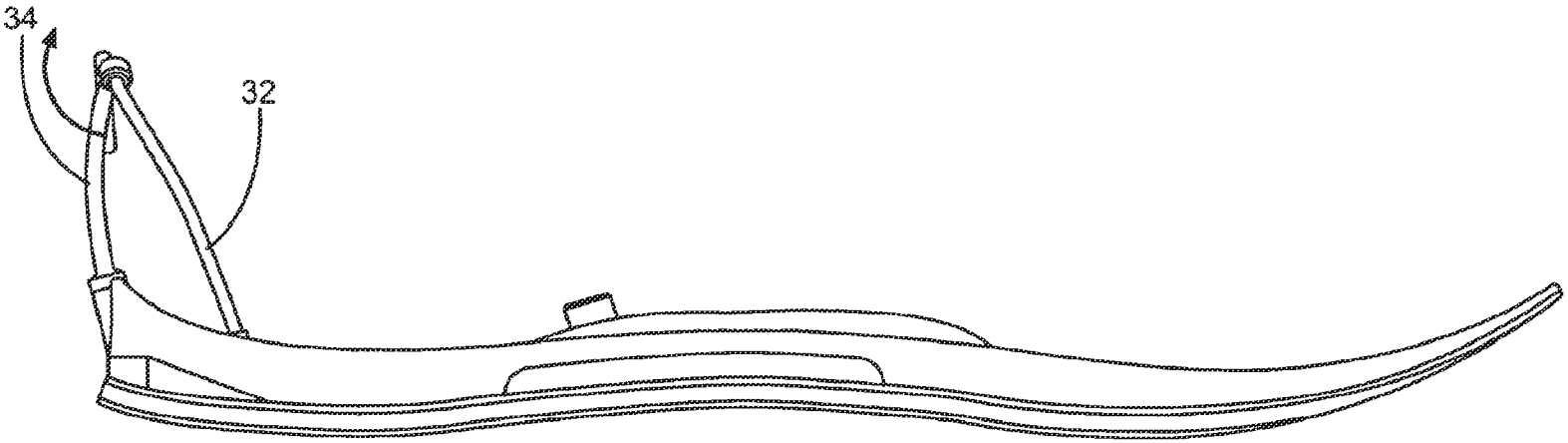

In the embodiment illustrated in FIGS. 9-11, a rear flexible loop 32 is attached to the rear lateral connection points and is supported by a pair of rear stays 34 that are connected to the rear connection points 16. The rear flexible loop 32 includes an upper spinning portion 36 that is disposed between the rear stays 34. The rear flexible loop 32, and in particular the upper spinning portion 36, is at least somewhat flexible, whereby the upper spinning portion 36 deforms when a force is applied to it. The upper spinning portion 36 may be surrounded by a flexible to semi-flexible material that allows the upper spinning portion 36 to move freely as the shoe is put on and taken off.

The upper spinning portion 36 includes a native position to which it naturally returns, such as due to memory of the material of which the rear flexible loop 32 is formed. The native resting (i.e. shoe closed) position may be further supported by the rear stays 34. This native position is illustrated in FIGS. 9 and 10.

In this embodiment, the user wishing to don the shoe pushes forward and down on the back of the shoe, causing the upper spinning portion 36 to deform first forward and then downward to assume a shoe-entry position illustrated in FIG. 11. In this position, a significant amount of room has been cleared at the back of the shoe, whereby the user's foot may more easily enter the shoe. When the user's foot fully enters the shoe, the upper spinning portion 36 returns to its original position, albeit possibly along a different path. Because the user's foot is in front of the upper spinning portion 36, the upper spinning portion 36 may be unable to return to its original position by moving forward and upward. Instead, the upper spinning portion 36 may instead move backward and upward.

The path of the upper spinning portion 36 is illustrated with respect to FIGS. 10 and 11. In FIG. 10, the curved arrow shows a rough representation of the path that may be taken by the upper spinning portion 36 as the user's foot enters the shoe. In contrast, the curved arrow in FIG. 11 shows a rough representation of the path that may be taken by the upper spinning portion 36 as it springs back to its native position after the user's foot enters the shoe. Thus, as the user's foot enters the shoe, the upper spinning portion 36 may take a spinning path to allow the user's foot to enter the shoe and to then return to its native position. Of course, the upper spinning portion 36 need not take this path every time it is displaced. For example, the upper spinning portion 36 may move backward and downward initially when the shoe is removed, and may return along that same path.

Figure 12:
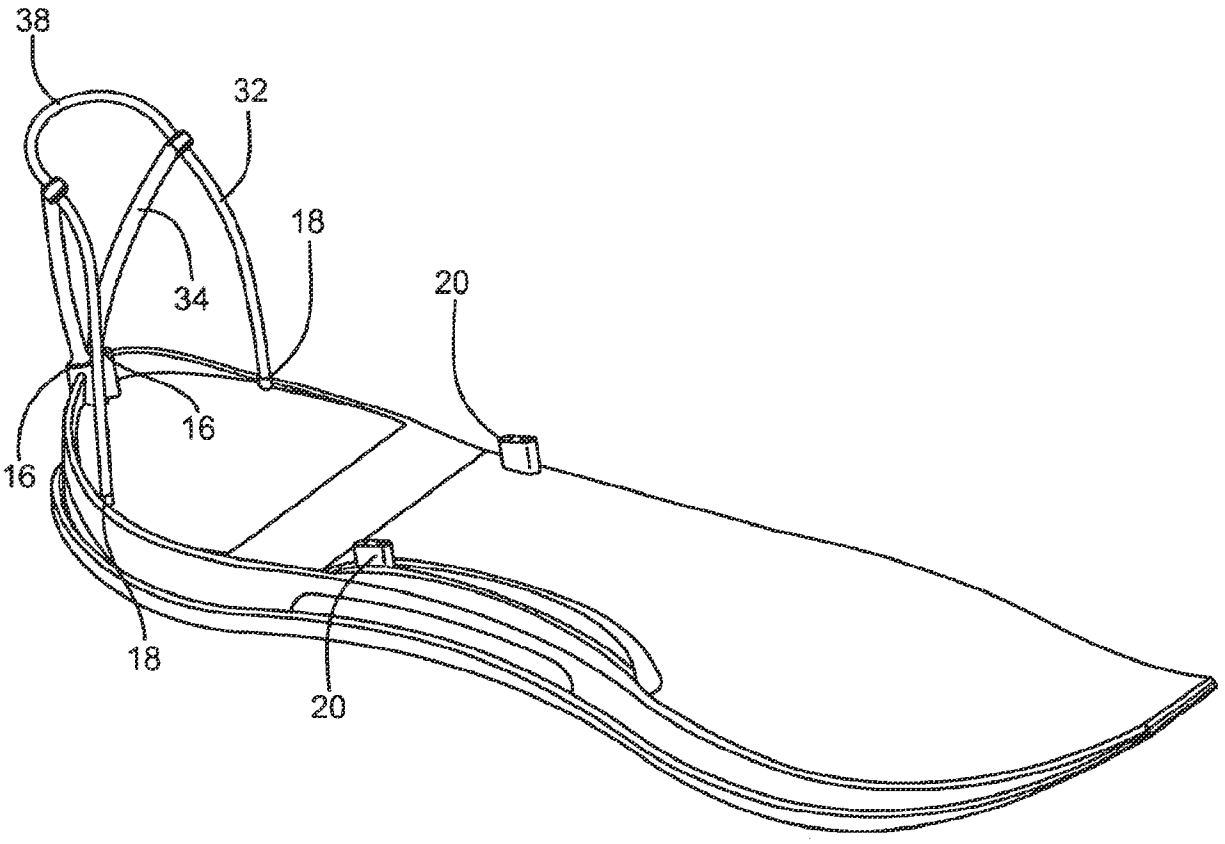
FIGS. 12-13 show various cutaway views of another embodiment of a shoe.
Figure 13:
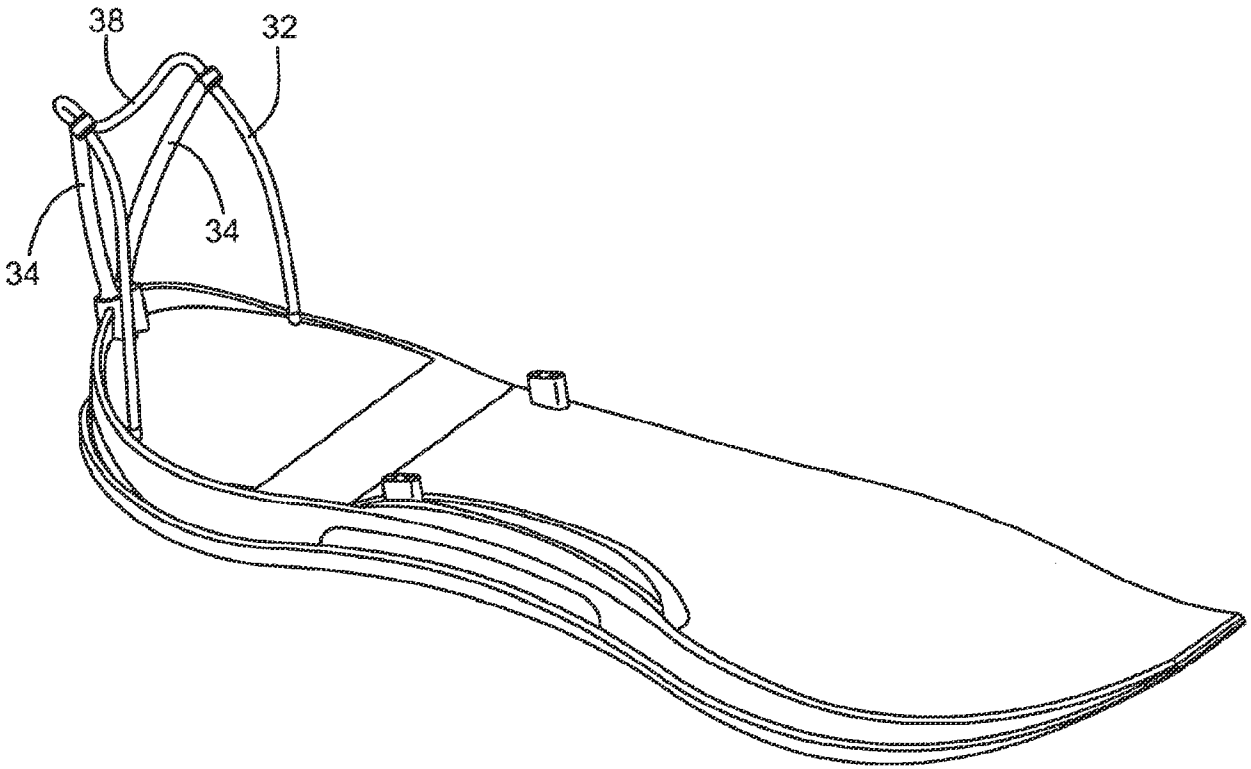

The embodiment of FIGS. 12-13 is designed to function along such a line, generally moving along a single path as the user's foot enters the shoe and when the embodiment returns to its native position. In this embodiment, the shoe also includes a rear flexible loop 32 and rear stays 34, although such features may be placed somewhat differently and/or have different shapes from the embodiment discussed with respect to FIGS. 9-11. Additionally, the rear flexible loop 32 includes a rear bending portion 38 instead of an upper spinning portion 36. In this embodiment, the rear bending portion 38 moves largely up and down as the user's foot enters and exits the shoe, thereby facilitating rapid entry into the shoe. Because of the up-and-down movement of the rear bending portion 38, the rear bending portion is not prone to inadvertently allowing the shoe to fall off the user's foot.

FIG. 12 shows the embodiment in the closed position, where the rear bending portion 38 is in its native upper position. FIG. 13 shows the embodiment in the open position, where the rear bending portion 38 is in a downward, flexed position, such as might be assumed under an externally-supplied force to allow the user's foot to enter and exit. Though not specifically illustrated in FIGS. 12 and 13, it should be appreciated that the rear stays 34 may flex somewhat as the user's foot enters and/or exits, possibly providing additional clearance for the user's foot.

Figure 14:
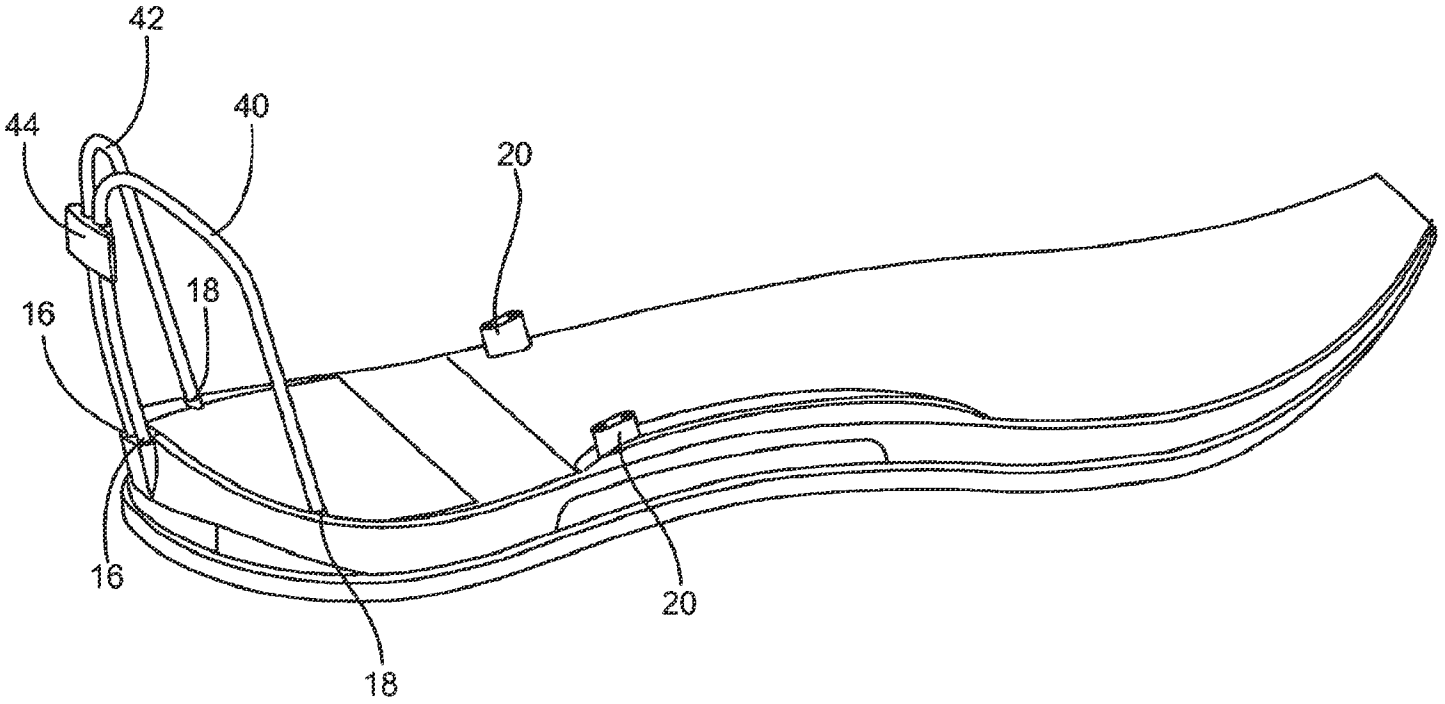
FIGS. 14-17 show various cutaway views of another embodiment of a shoe.
Figure 15:
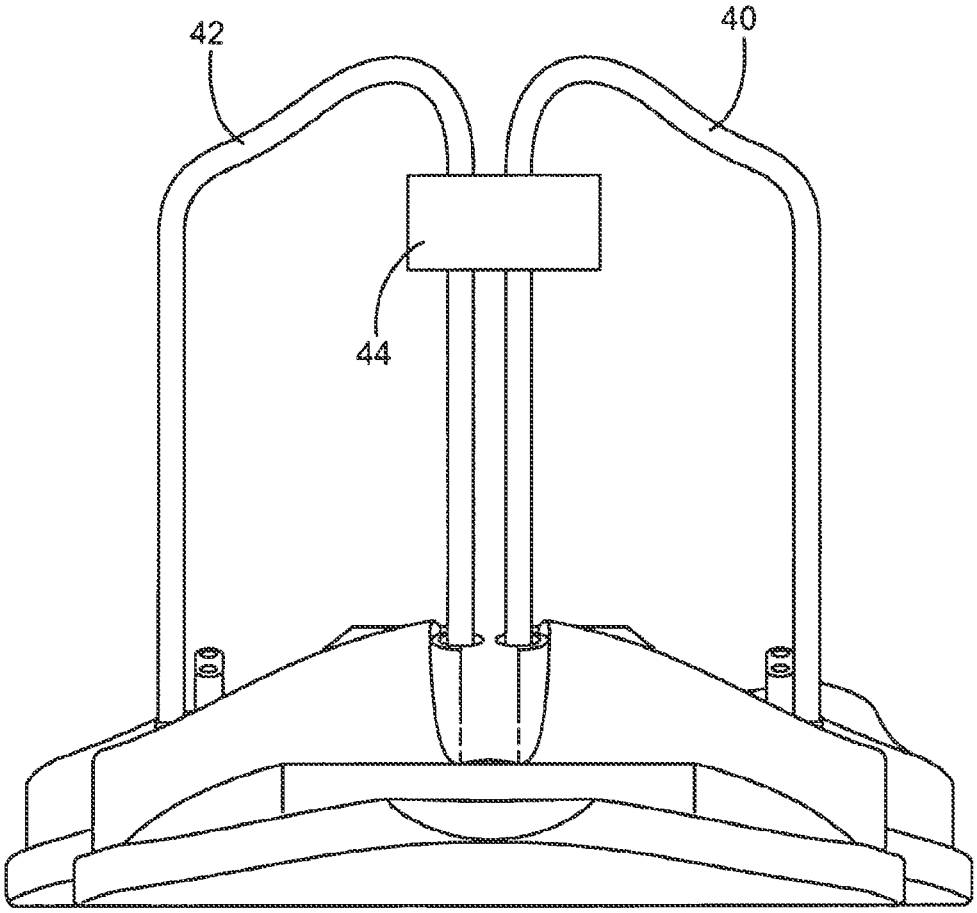
Figure 16:
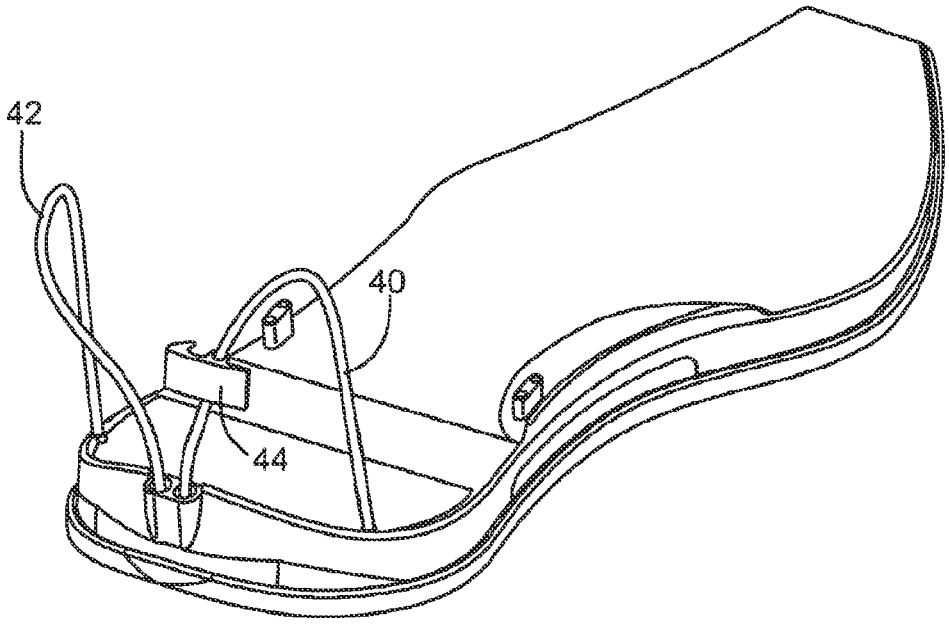
Figure 17:
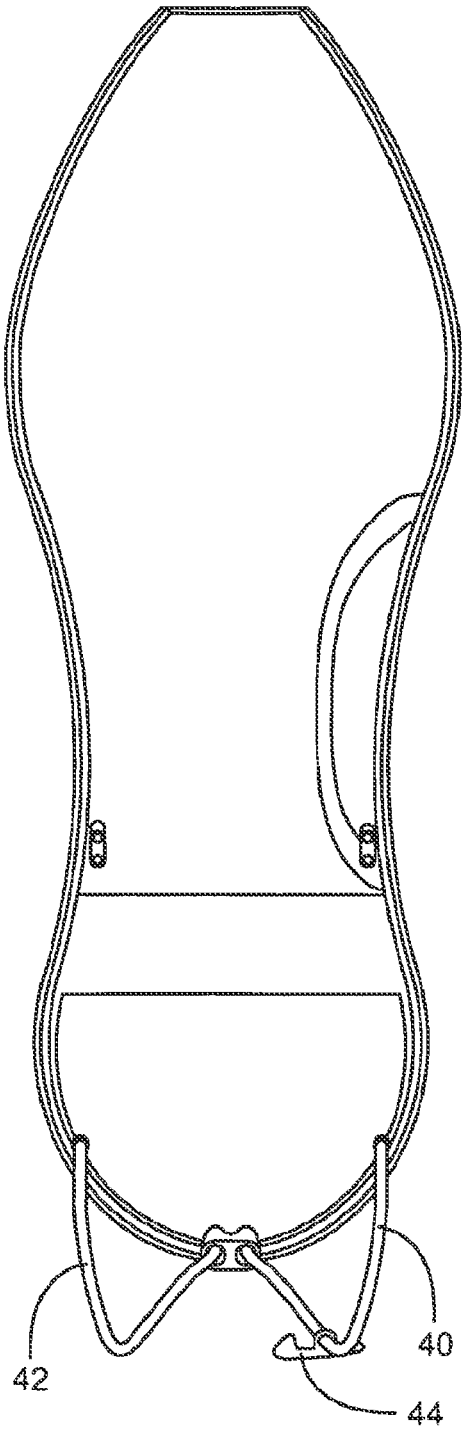

FIGS. 14-17 show an additional embodiment that utilizes primarily the rear connection points 16 and the rear lateral connection points 18. This embodiment provides a split entry into the back of the shoe, whereby the user can put his or her foot partially into the shoe, press downward on a rear portion of the shoe to cause the rear portion to split open to allow additional room for the user's foot to enter the shoe. FIGS. 14 and 15 show the shoe in a closed position, while FIGS. 16 and 17 show the shoe in a split, open position.

In this embodiment, a right split loop 40 and a left split loop 42 are shown. The right split loop 40 extends from a rightward of the rear lateral connection points 18 to a rightward of the rear connection points 16, while the left split loop 42 extends from a leftward of the rear lateral connection points 18 to a leftward of the rear connection points 16. The right split loop 40 and the left split loop 42 are formed from a material and attached to the shoe in such a way as to assume a native configuration where the rear of the shoe is closed, as illustrated in FIGS. 14 and 15.

Although the split rear entry facilitates entry into and exit from the shoe, it may be desirable for the user to be able to lock the rear entry so the shoe more securely holds the foot. Therefore, the illustrated embodiment includes a rear pivoting lock 44. The rear pivoting lock 44 is pivotally attached to one of the right split loop 40 and the left split loop 42 and is able to reversibly latch onto the other of the right split loop 40 and the left split loop 42, thereby locking the two together. The rear pivoting lock 44 may be actuated through any material of the shoe to either lock or unlock, and can be actuated by a simple tap, such as using the user's other foot. Of course, a flexible or semi-flexible material may be provided at the split point at the rear of the shoe so that the two sides of the shoe do not completely split apart, but rather provide significant room for entry/exit of the user's foot. In this way, the rear pivoting lock 44 might never be exposed during use of the rapid-entry features of the shoe. The rear pivoting lock 44 may be left open when a roomier, loose fit is desired, and may be optionally locked when a tighter fit (such as for athletic activities) is desired.

Figure 18:
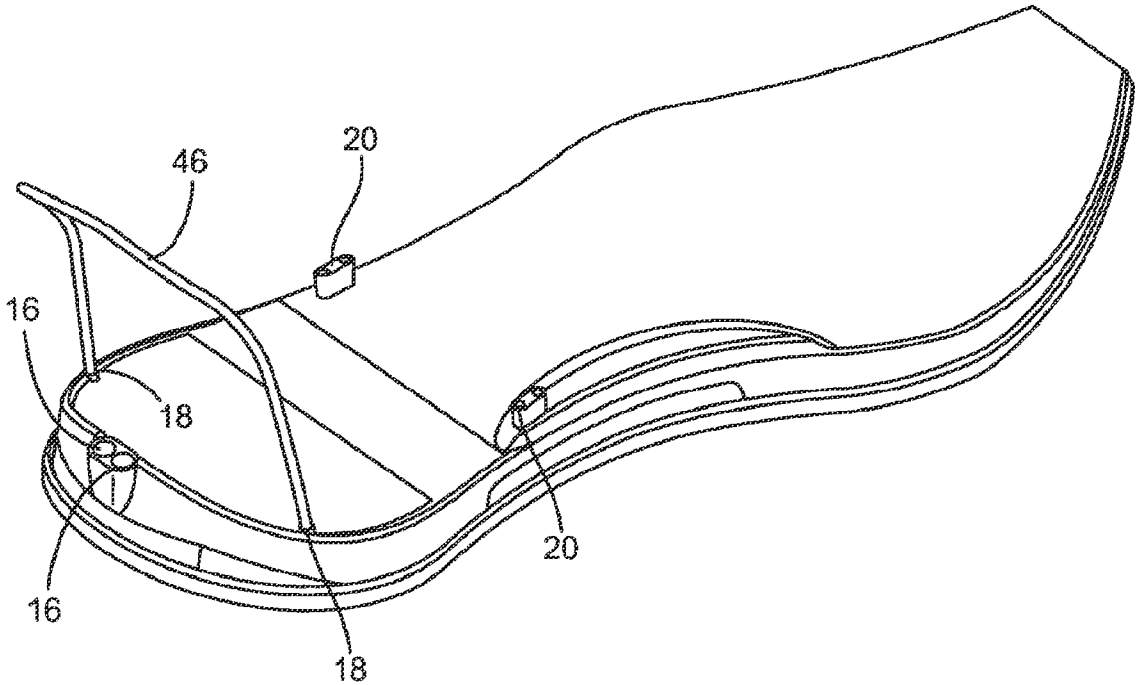
FIGS. 18-21 show various cutaway views of another embodiment of a shoe.
Figure 19:
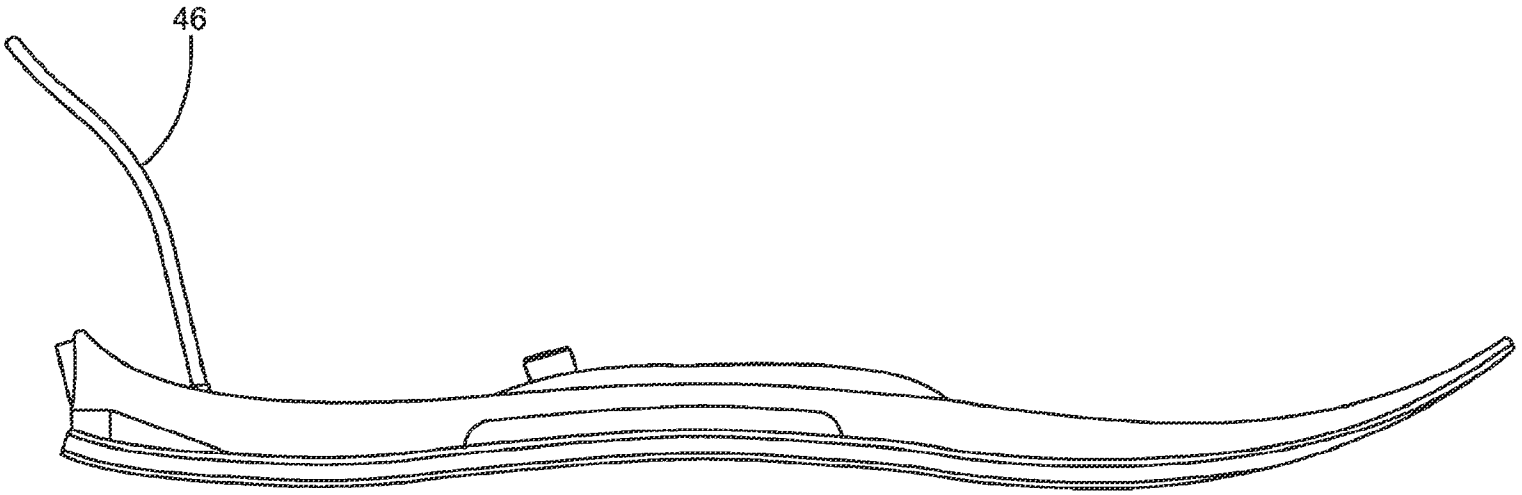
Figure 20:
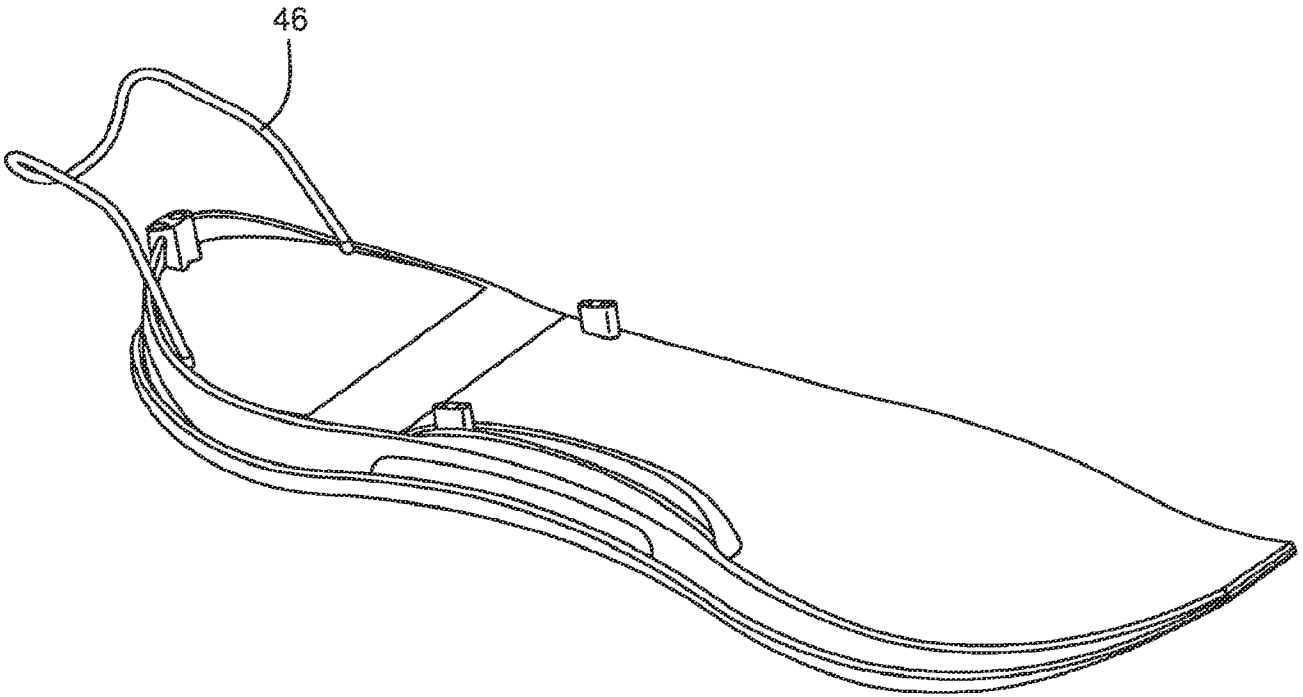
Figure 21:
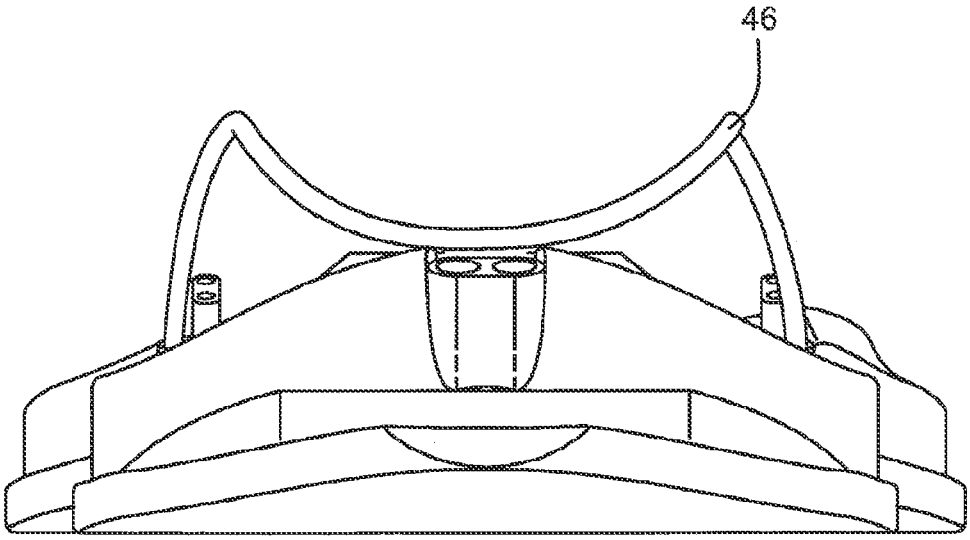

FIGS. 18-21 illustrate an alternative embodiment of a rapid-entry shoe. The rapid-entry feature of this shoe is a rear folding loop 46 that utilizes only the rear lateral connection points 18. FIGS. 18-19 show this embodiment in the native, closed position, while FIGS. 20-21 show this embodiment in an open position where the rear folding loop 46 has been pushed downward and back to allow rapid entry into the shoe. The function of this embodiment is similar to those described above and is self-evident from the accompanying Figures.

Figure 22:
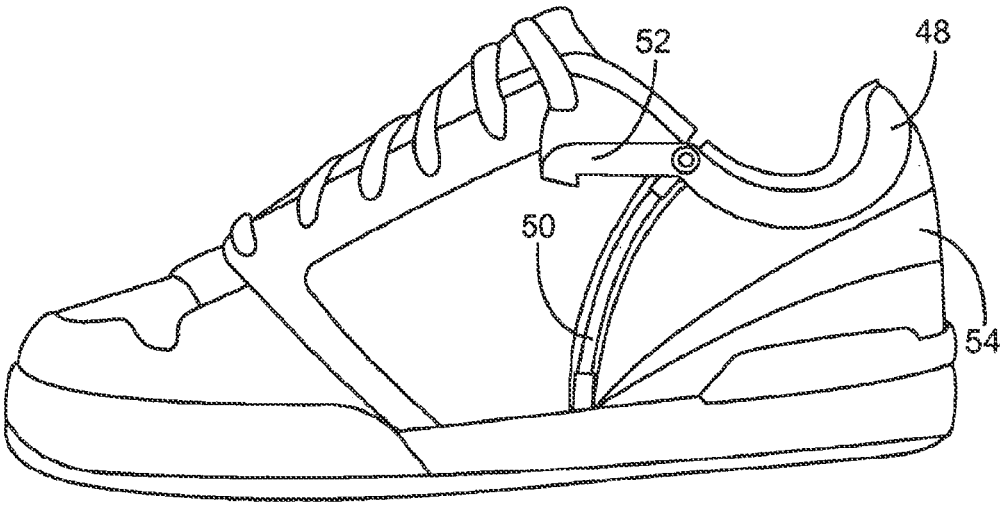
FIGS. 22-24 show various partial-cutaway views of another embodiment of a shoe.
Figure 23:
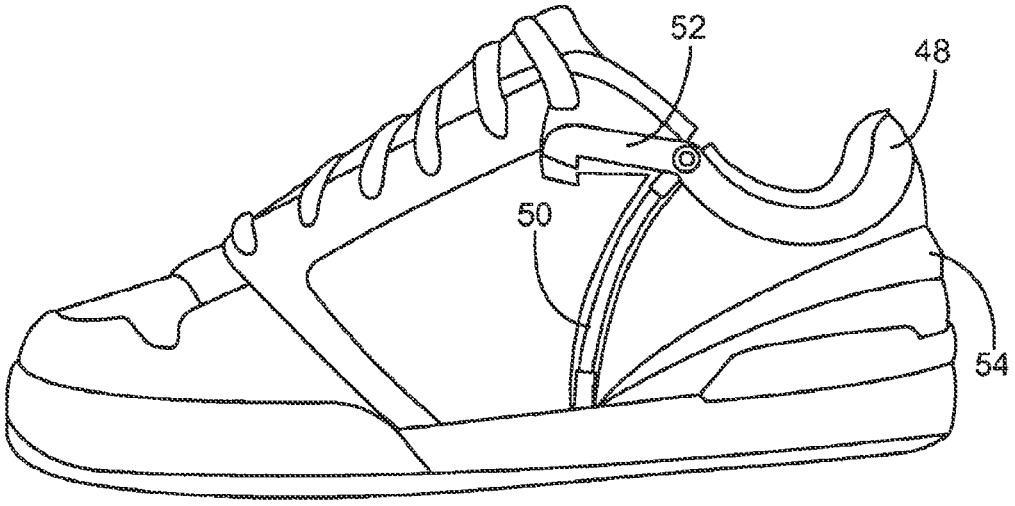
Figure 24:
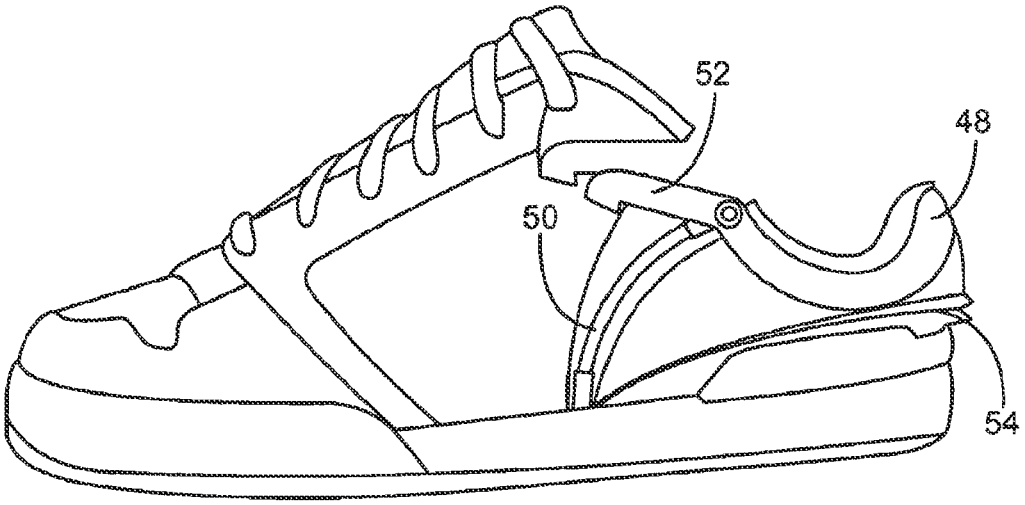
Figure 25:
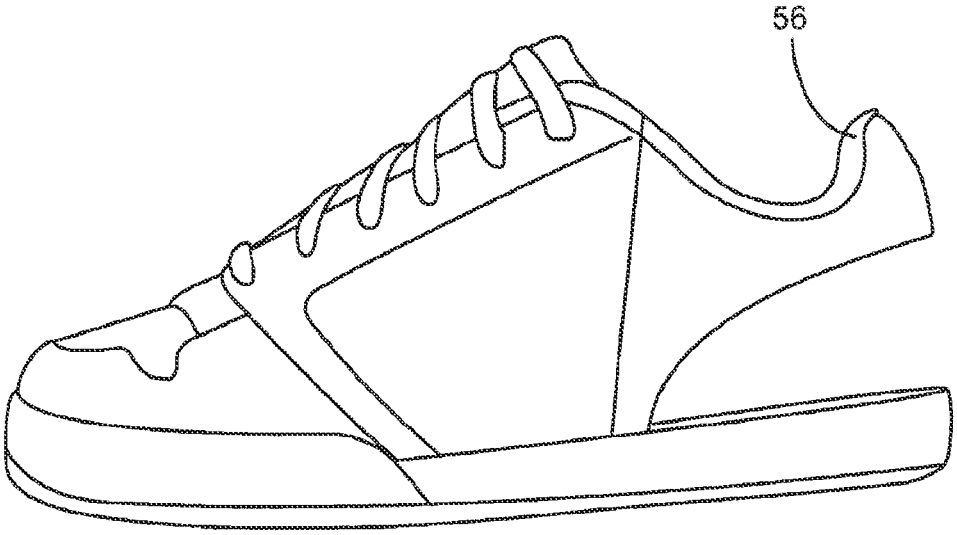
FIGS. 25-26 show various partial-cutaway views of another embodiment of a shoe.

FIGS. 22-24 illustrate another alternate embodiment, this one utilizing primarily the front connection points 20. The shoe incorporates a locking loop 48 connected to a flexible stay 50 on each side of the shoe. The flexible stays are attached to the front connection points 20. The locking loop 48 includes a locking portion 52 that serves to keep the shoe from opening inadvertently, as shown in FIG. 22. A user applies a downward pressure to the back of the shoe, which causes the locking portion 52 of the locking loop 48 to unlock, as shown in FIG. 25, so the shoe can be opened. Further downward pressure causes the flexible stays to flex as shown in FIG. 24, allowing the shoe to open. Once the user's foot is inserted or removed, the reverse process may occur, whereby the shoe returns to a closed and locked position for use.

This movement occurs through compression or flexing of a flexible rear portion 54 of the shoe that may serve to cause the shoe to resemble any standard shoe when not opened. In FIGS. 22-24, a portion of the shoe has been cut away to facilitate understanding of the functions of the shoe. It is anticipated that the locking portion 52 and the flexible stay could remain hidden within the shoe and not normally be visible. However, in some embodiments, if the user wished to have a shoe displaying such technological features, it is anticipated that one or more functional elements might remain exposed and visible.

Figure 26:
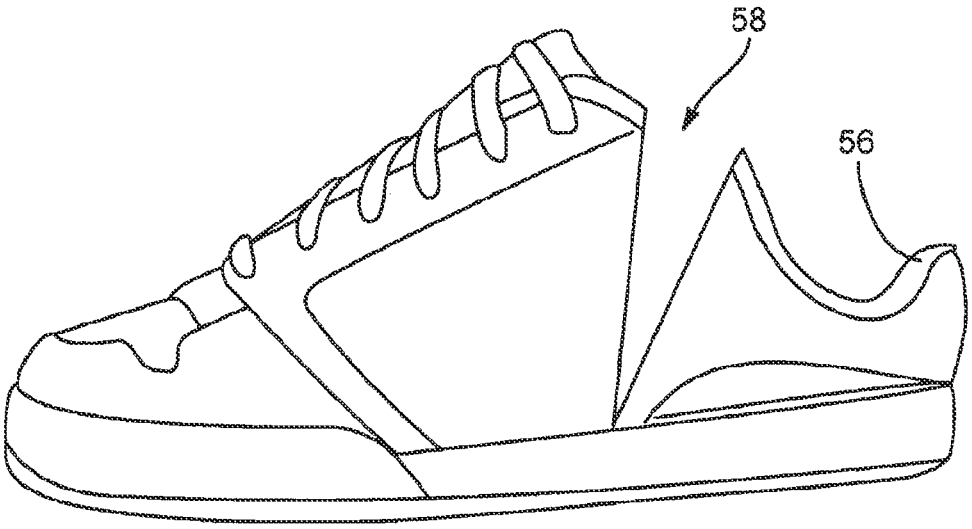

FIGS. 25-26 illustrate an embodiment similar to that of FIGS. 6-8; however, in this embodiment, the movable portion of the shoe flexes generally close to the sole of the shoe, as shown in the Figures. In FIGS. 25-26, a heel portion of the shoe has been cut away to show functioning of the rapid-entry features. It should be understood that the heel may be enclosed by a flexible to semi-flexible material, by a compressible material, or by the equivalent. FIG. 25 shows the shoe as it might normally appear (absent the cut-away heel) where it resembles a standard shoe. However, as illustrated in FIG. 26, when a downward pressure is applied to the back top 56 of the heel area, the shoe opens at a slit 58, which may normally be covered by a piece of flexible material. This opening of the slit 58 allows the shoe to open for rapid entry of the user's foot. As the downward pressure on the back top 56 is not normal during normal use of the shoe, the shoe stays on the user's foot with little danger of inadvertent loosening of the shoe.

In each of the examples discussed above, the sole support 10 is connected to one or more deformable elements using the various connection points. In each example, the deformable element (e.g. paddle loop 22, rear flexible loop 32, right split loop 40 and left split loop 42, rear folding loop 46, and flexible stay 50) has a native position to which the deformable element naturally returns when no deforming force is present. While not specifically illustrated in the Figures, it should be understood that the native position may not be an unstressed position. In fact, the native position may already be somewhat stressed to increase the force with which the deformable element returns to the native position. The deformable element may be maintained or held in the native position by other shoe elements not necessarily shown in the Figures, such as components of the shoe upper.

Figure 27:
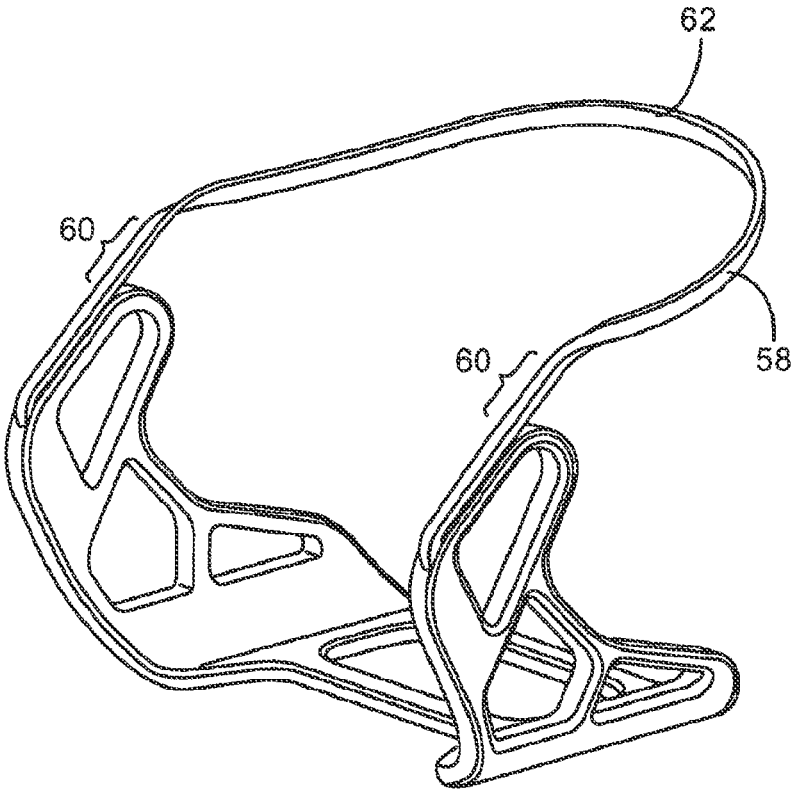
FIGS. 27-28 show perspective views of shoe components for providing rapid entry into a shoe.

FIG. 27 shows a deformable shoe component configured to provide rapid-entry features to shoes. As may be seen in FIG. 27, the component is configured to be inserted or manufactured into a heel portion of a shoe and may then be covered by shoe cushioning components and the like. The component shown in FIG. 27 utilizes a deformable element 58 that has springiness or memory to return to the configuration shown in FIG. 27. While any of a variety of materials may be used for the deformable element 58, one exemplary material for the deformable element 58 is a flat steel spring wire similar to those used in pop-up tents and the like. The remaining body of the shoe component may include plastics, metals, composites and the like.

In the illustrated embodiment, the deformable element 58 includes a bendable portion 60 wherein the deformable element 58 is turned so as to facilitate bending at the bendable portion 60 so as to allow a loop portion 62 to move upward and downward. The loop portion 62 of the deformable element is turned so as to permit a desired bending of the loop portion 62 around the back of the user's heel/ankle while being resistant to undesired bending in other directions. As with several other embodiments discussed herein, rapid entry into a shoe containing the component shown in FIG. 27 permits the user to press downward on a back portion of the shoe, insert his or her foot, and the springiness of the deformable element 62 causes the back portion to spring back up. The back portion does not tend to inadvertently release, as it is only susceptible to downward motion which is not normally encountered during use except when removal of the shoe is desire. Rapid exit may be readily achieved using the user's hand or other foot or any other object to press downward on the back portion.

Figure 28:
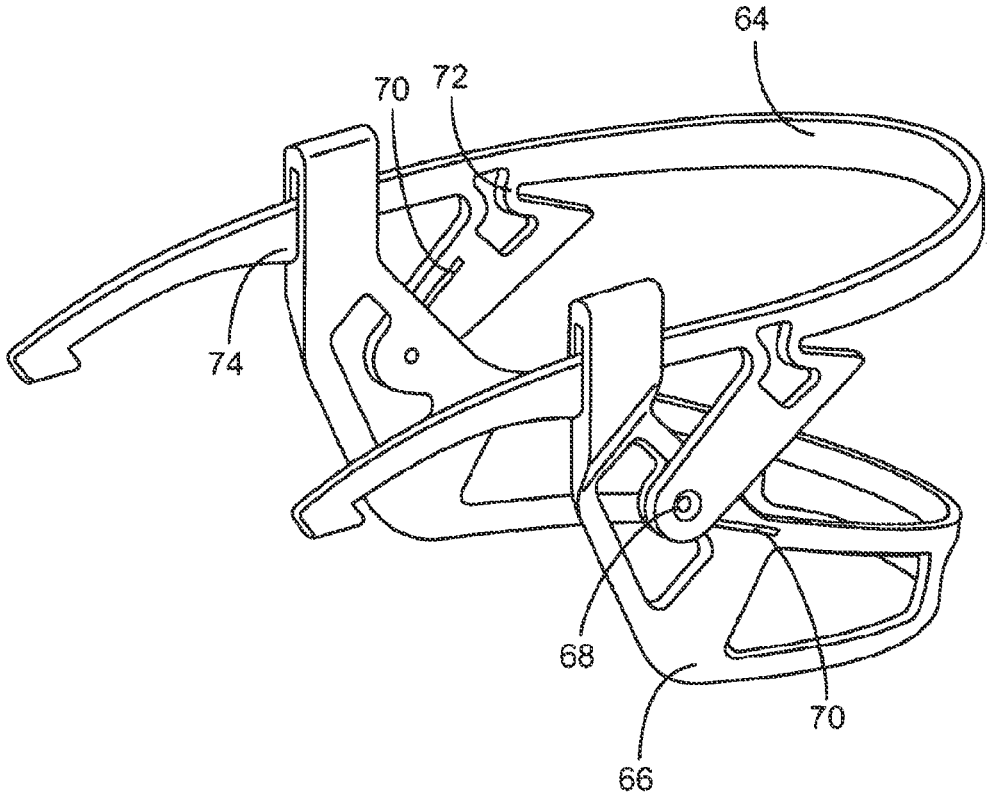

FIG. 28 shows an alternative deformable shoe component. This component may be made of a variety of materials, such as plastics, metals, composites, and the like, or may incorporate several such materials. The illustrated embodiment includes a heel loop 64 that is connected to a body 66 at a hinge 68. At the hinge, a spring 70 biases the heel loop 64 upward. The heel loop 64 includes a flexible portion 72 and a lock 74 that together serve to allow rapid entry into the shoe while minimizing undesired release of the shoe. Specifically, in the position shown in FIG. 28, the lock 74 is engaged. When the user initially presses downward on a rear portion of the heel loop 64, the lock 74 prevents the heel loop 64 from rotating about the hinge. Instead, the flexible portion 72 flexes until the lock 74 is disengaged, after which the heel loop 64 is free to rotate about the hinge 68 as the user presses down further on the heel loop 64. Thus, as the heel loop 64 is initially pressed downward, its rear portion travels substantially downward and possibly slightly forward initially, due to the positioning of the flexible portion 72. After the lock 74 disengages, the heel loop 64 moves both down and backward due to positioning of the hinge 68, with more backward motion achieved the farther down the hinge 68 is placed. This backward movement may further assist in allowing the user's foot to enter the shoe. The lock 74 prevents unwanted backward movement (e.g. rotation about the hinge 68) until the lock 74 is released.

Figure 29:
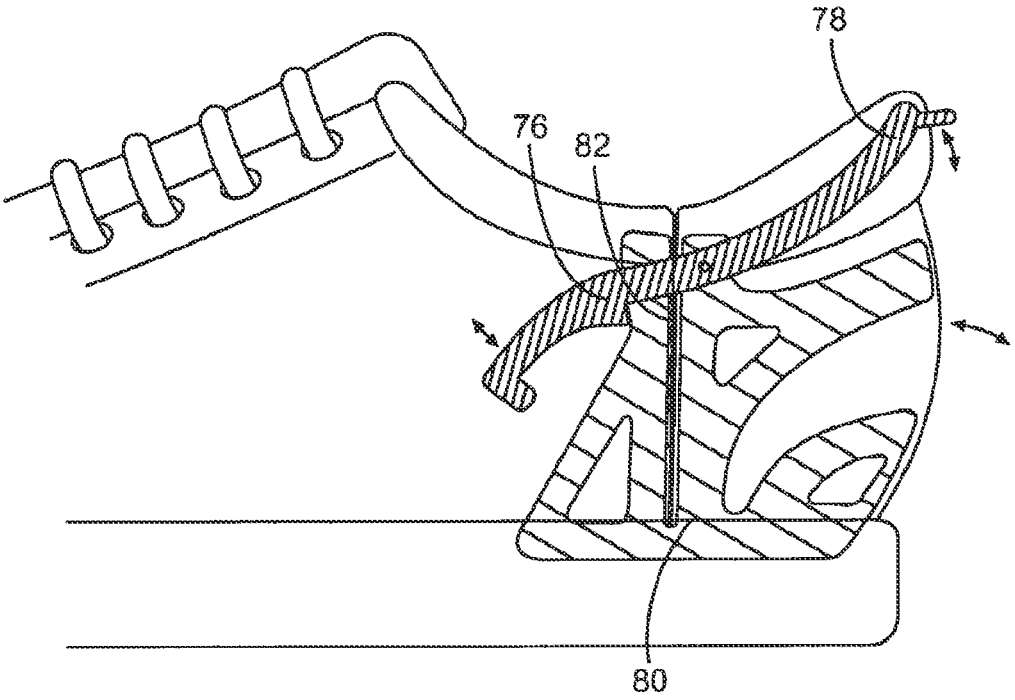
FIGS. 29-33 show side plan views of various shoe components for providing rapid entry into a shoe.

FIGS. 29-33 show plan views of various structures that may be incorporated into a rapid-entry shoe of varying types. In the embodiment of FIG. 29, the structure includes a lock 76 similar to the lock 74. The lock 76 is disengaged by initial downward motion of a heel loop 78 as shown in FIG. 29. Then, continued downward pressure causes the heel portion of the shoe to move down and back, rotating about an axis of rotation 80 as shown. Because the axis of rotation 80 is located low in the shoe, it permits significant rearward motion of the rear portion of the shoe (thus opening a slit 82 in the structure that may optionally be hidden under material) to facilitate entry into the rapid-entry shoe. The lock 76 re-engages after the user has the shoe fully on, and prevents unwanted rearward (e.g. opening) movement of the rear portion of the shoe until the heel loop 78 is pressed downward enough to disengage the lock 76, whereupon the shoe can be readily removed.

Figure 30:
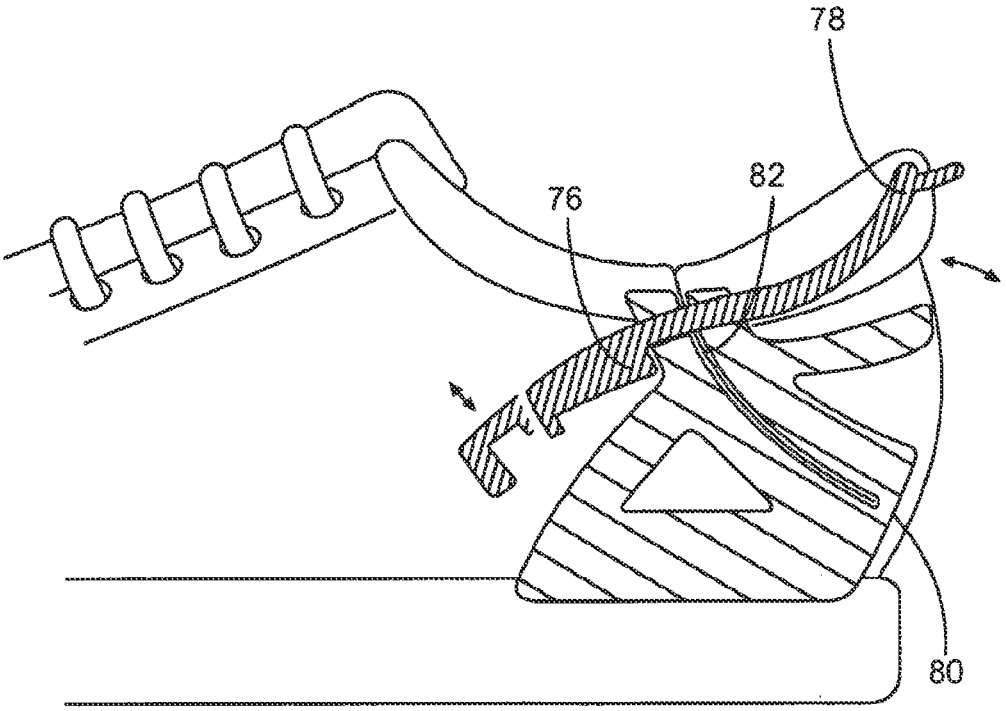
Figure 31:
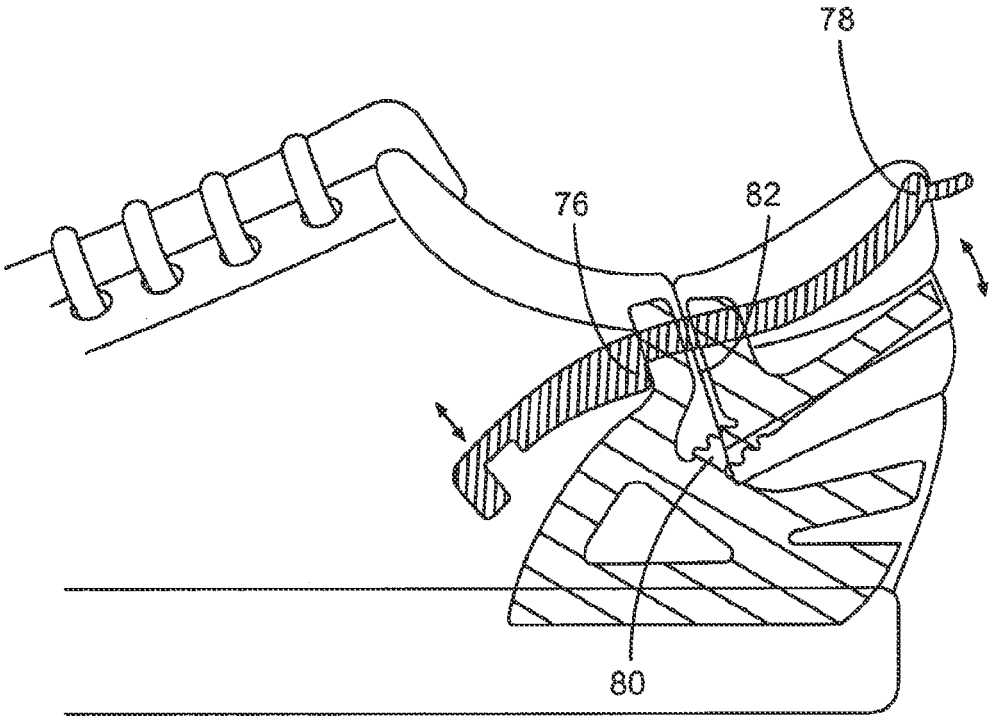

FIG. 30 includes features similar to those shown in FIG. 29, but the rearward motion of the rear portion of the shoe is even more pronounced in this embodiment, as the axis of rotation 80 has been moved rearward significantly. Of course, the axis of rotation 80 may be moved to any of a variety of intermediary locations depending on the exact desired movement of the rear portion of the shoe for rapid entry. FIG. 31 shows another such example, with the axis of rotation moved upward and forward significantly compared with the embodiment of FIG. 30, whereby the motion of the rear portion of the shoe after the lock 76 is disengaged is significantly more downward and less rearward.

Figure 32:
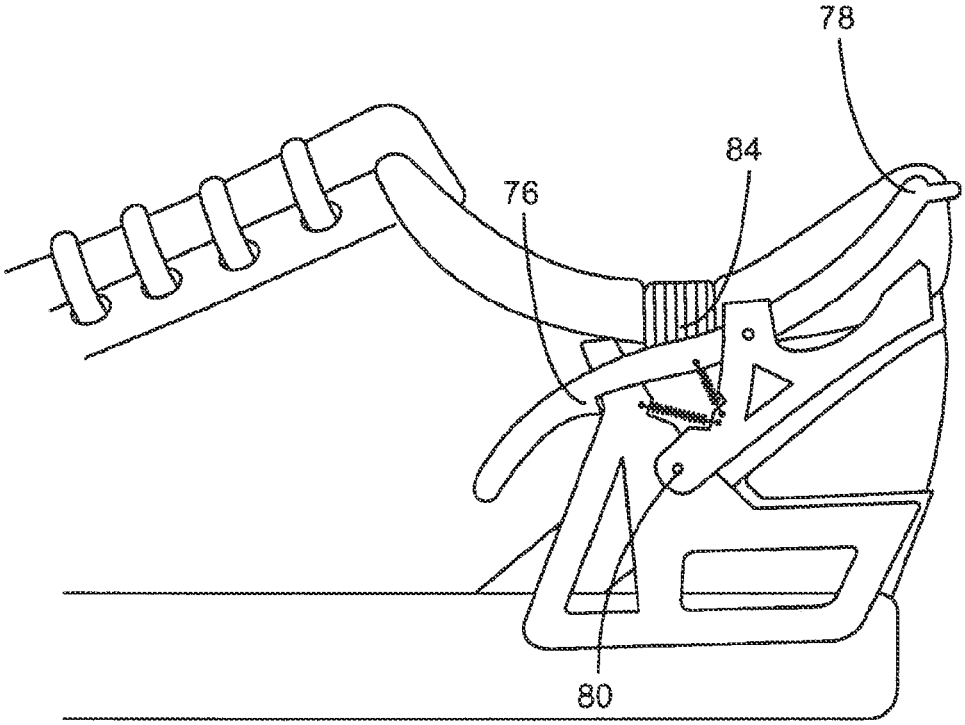

FIG. 32 shows another embodiment, where the axis of rotation 80 is forward and up somewhat. Again, the lock serves to prevent unwanted rearward (e.g. opening) of the rear portion of the shoe unless the heel loop 78 is purposely pushed downward. In this case, the axis of rotation 80 is provided by a hinge, while in the embodiments of FIGS. 29-31, the axis of rotation is provided by design of the component body, such as by designing in a flexible location in the body. In embodiments where the axis of rotation 80 is provided by a hinge, one or more springs may be used to cause the movable portion of the shoe to return to a position where the lock 76 may engage, while in embodiments where the flexible location is used to provide the axis of rotation 80, the natural desire of the material to return to its native position may cause the movable portion to return to a position where the lock 76 may engage. Where the axis of rotation is provided by a hinge, there may be no need to provide a slit 82 in the structure and instead a flexible portion 84 of the shoe is provided to allow the rear portion of the shoe to move for rapid entry and removal.

Figure 33:
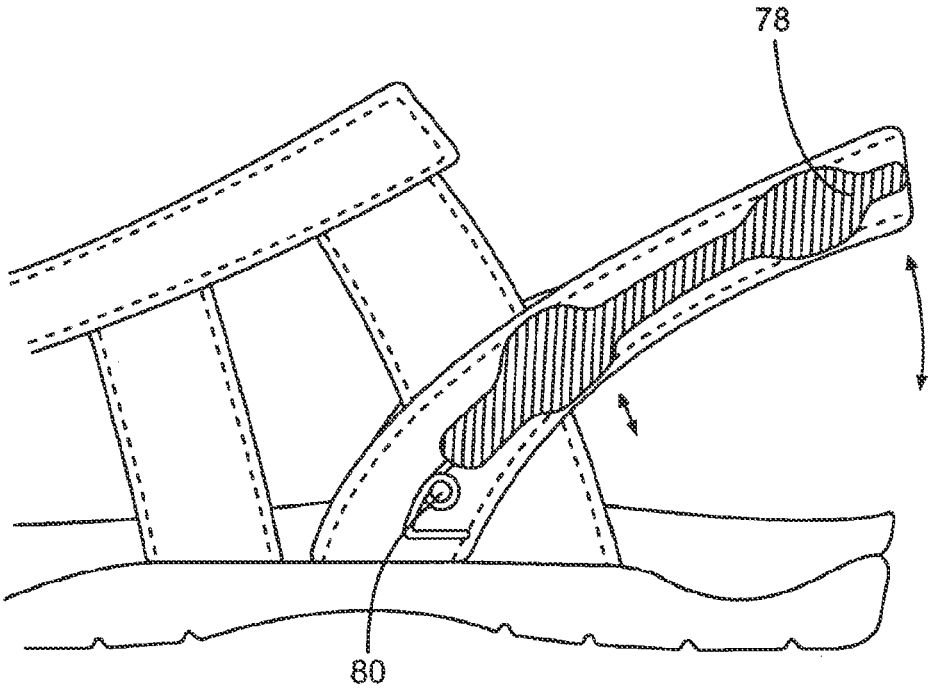

FIG. 33 shows an alternate embodiment illustrated as being used in a sandal-type shoe, although the illustrated embodiment could also be used in a closed-type shoe. In this embodiment, the axis of rotation 80 is forward and down and is associated with a spring. The spring provides an upward force on the heel loop 78, causing the heel loop 78 to return upward to secure the user's foot once entry into the sandal has been achieved.

While many of the embodiments discussed previously provide systems that are naturally biased to a position that secures the user's foot in the shoe, other embodiments may be provided that are naturally biased to an open position ready to receive the user's foot.

FIGS. 34-37 are examples of such embodiments. While the examples of FIGS. 34-37 are illustrated with respect to sports-type shoes, it should be understood that the illustrated principles may be applicable to all types of shoes. FIGS. 34-37 each illustrate the embodiments in two positions, first in a position ready to receive the user's foot (an open position), and second a foot-securing position after rapid entry of the shoe has been achieved. In these embodiments, rapid entry into the shoe is provided by opening a tongue 86 of the shoe.

FIGS. 34-37 show embodiments where the system is naturally biased to an open position. The embodiment includes a moveable insole 88. The insole 88 is biased into a position where a rear portion of the insole 88 extends upward significantly above its normal resting position when the shoe is being worn, as shown at the top of FIGS. 34-37. A rear portion of the insole 88 is connected to the tongue 86 by a connecting band 90 that causes the tongue 86 to move approximately in concert with the rear portion of the insole 88. Thus, as the user inserts his or her foot into the shoe and presses down with his or her heel on the insole 88, it causes the rear portion of the insole 88 to move downward while simultaneously the connecting band 90 causes the tongue 86 to close over the user's foot.

As the rear portion of the insole 88 reaches its lowest position, an element of either the insole 88 or the connecting band 90 engages an engaging element 92 under the insole 88. The engaging element 92 secures the shoe in a closed position against at least most unwanted release of the shoe. The engaging element 92 and any corresponding structure on the insole 88 or connecting band 90 may take a variety of forms as long as they provide a reasonably-secure engagement. A variety of mechanisms may be used to disengage the engaging element 92, including an external actuator 94 that may be located on a rear surface of the shoe or on an outer side of the shoe to minimize inadvertent actuation. Alternatively, the disengagement may be achieved by simply increasing an upward force on the tongue 86 (and thus the connecting band 90) beyond a level normally achieved in using the shoe except when the shoe is desired to be removed.

Figure 34:
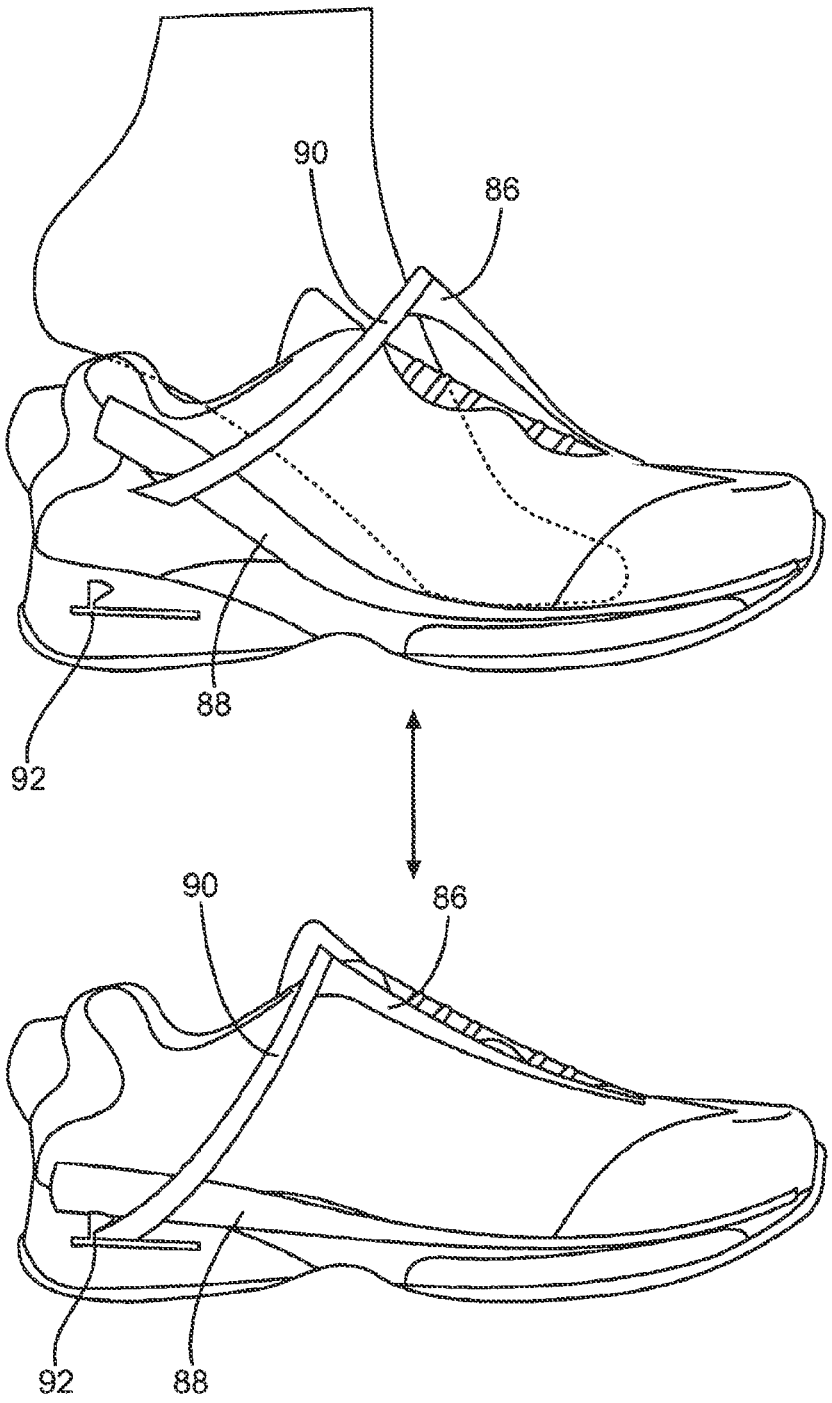
FIGS. 34-37 show side plan views of various systems for providing rapid entry into a shoe, each system being illustrated in two operating positions.
Figure 36:
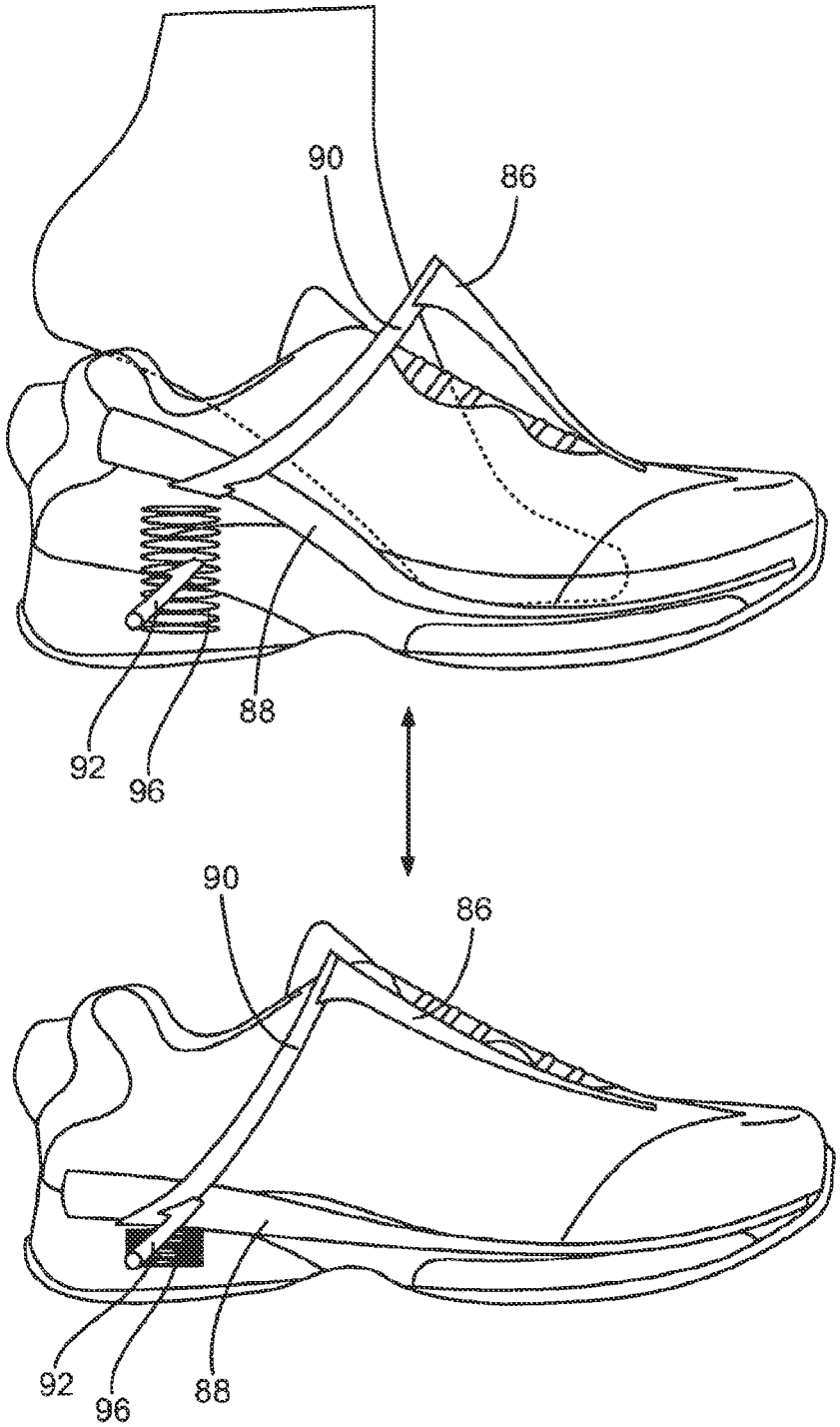
Figure 37:
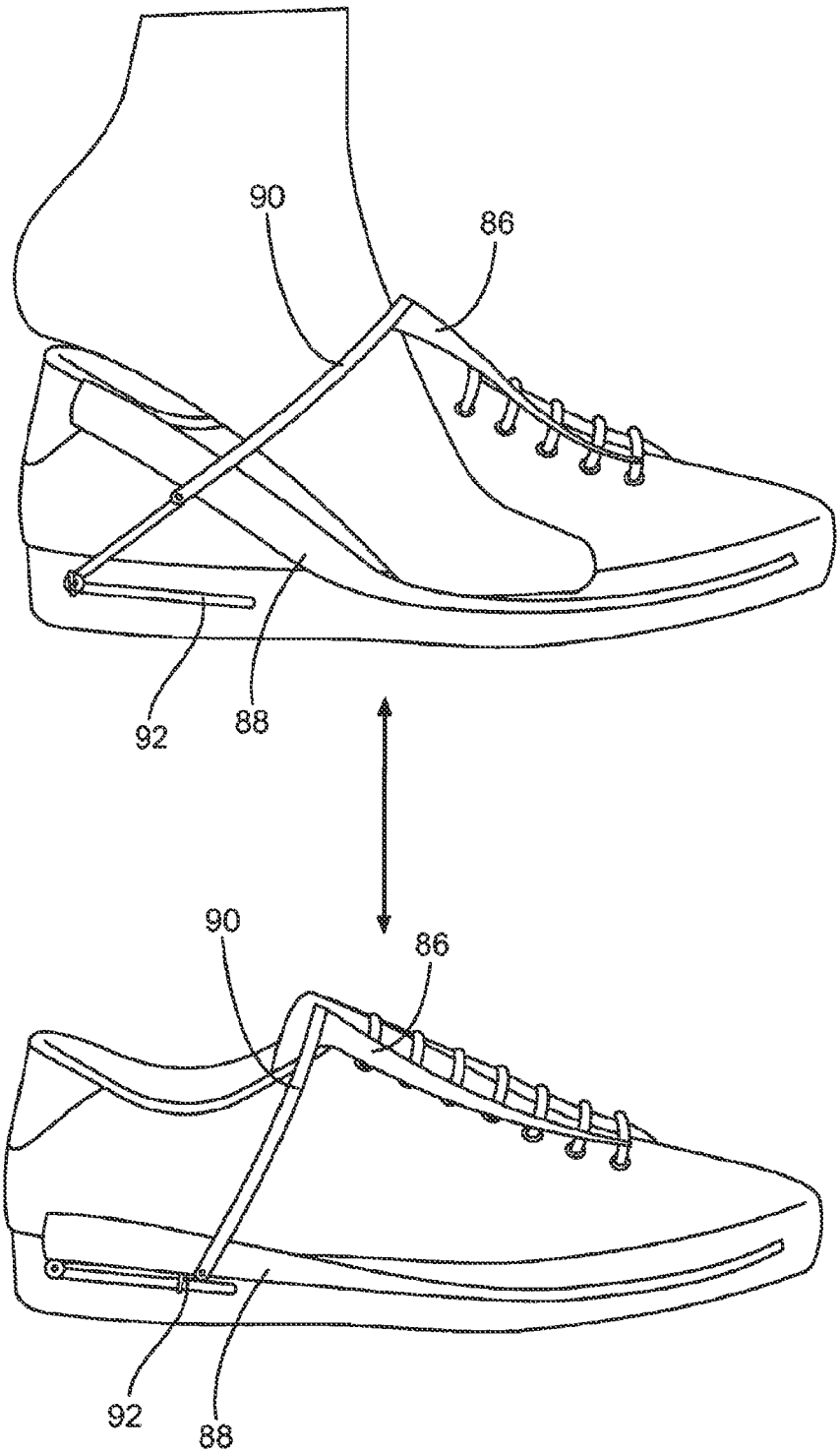

The various structures and elements may vary between embodiments. For example, FIG. 34 shows an embodiment where the upward biasing on the insole 88 and tongue 86 may be achieved by way of the tongue 86 or insole 88 itself, without any additional elements. In contrast, in the embodiment of FIGS. 35 and 36, a spring 96 is used to upwardly bias the insole 88 and thereby the tongue 86 through the connecting band 90. In the embodiment of FIG. 37, a spring-biased bar may be used.

Figure 35:
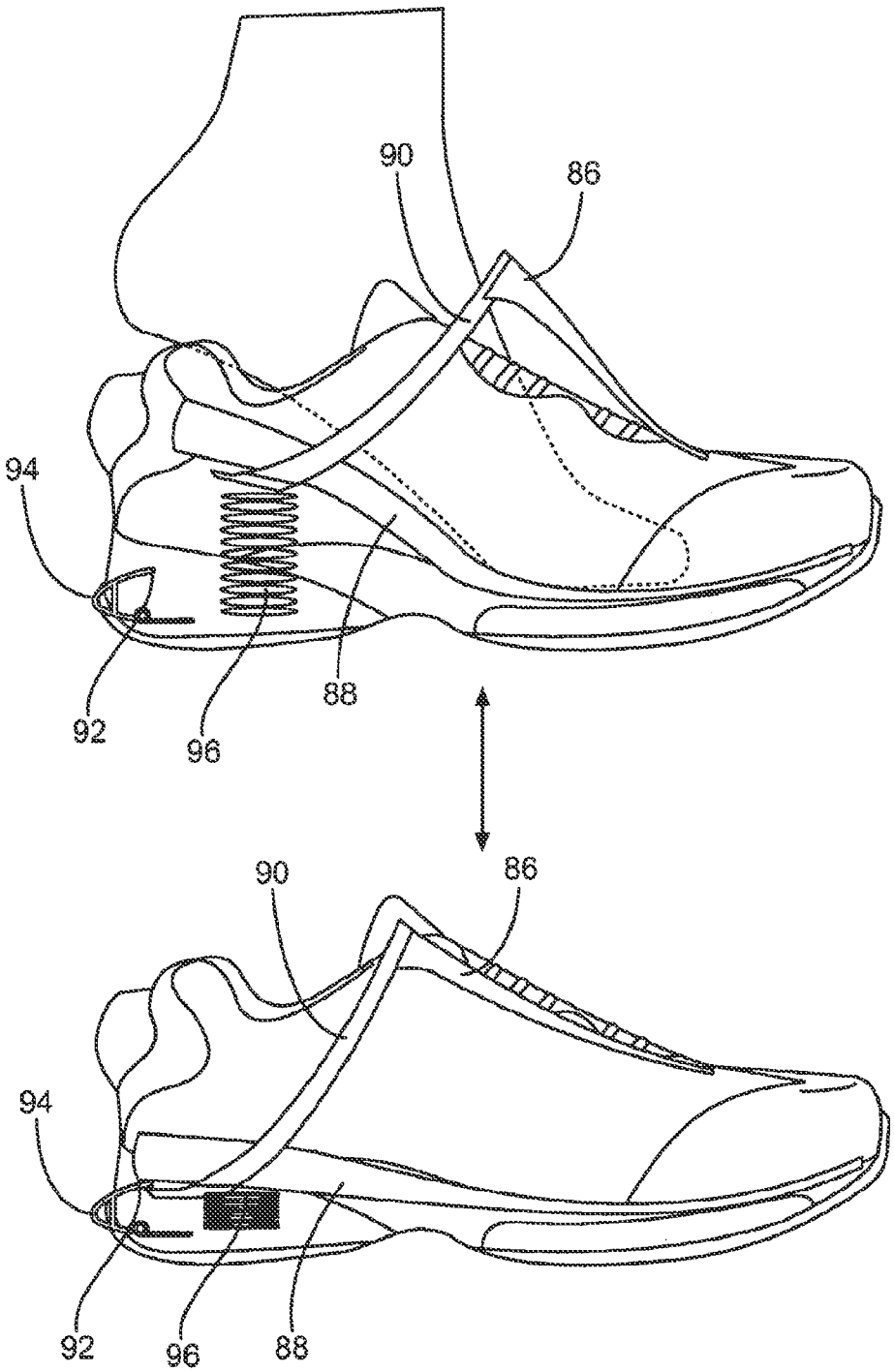

In the embodiment of FIG. 34, no external actuator 94 is present, and the user's foot is removed by exerting a force on the tongue 86 that is beyond the force normally encountered in wearing the shoe. In the embodiment of FIG. 35, the external actuator 94 is present on a rear portion of the shoe. In the embodiment of FIG. 36, the external actuator 94 (not shown) may be present on a side of the shoe. In FIG. 37, the spring-biased bar may have multiple positions of rest where one is the downward biased position. This shoe is removed in a fashion similar to that of FIG. 34.

Figure 38:
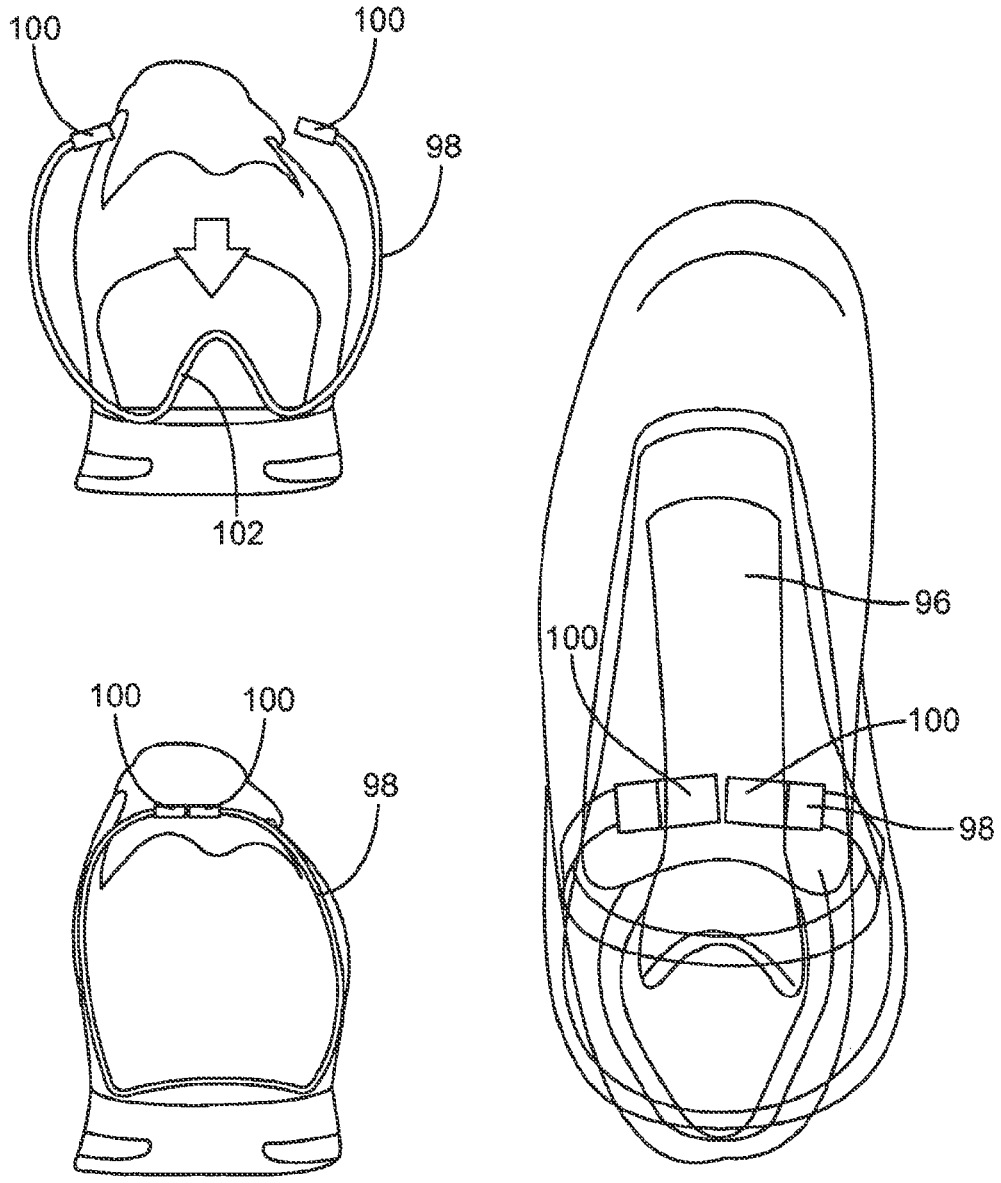
FIG. 38 shows various plan views of a system for providing rapid entry into a shoe.

FIG. 38 shows an alternative manner for providing a shoe that is normally biased open. This shoe relies on a memory metal band 98 that terminates at each end within or near the tongue 86 of the shoe in a pair of magnets 100. The memory metal band 98 has a normal memory position as shown in the upper left rear view of FIG. 38. As the user steps into the shoe, the user's heel presses down on a raised ridge 102 incorporated into the normal memory position. As the memory metal band 98 is contained within and constrained by the structure of the shoe, downward pressure on the raised ridge 102 causes the free ends of the memory metal band 98 to be drawn together until the magnets 100 interact with each other and finish pulling the shoe closed. In some instances, the magnets 100 are "programmable magnets" otherwise known as "correlated magnets," whereby the magnets 100 have significant strength of attraction when oriented properly to each other, but little attraction or even repulsion if adjusted only slightly in their relative orientation. This effect is achieved by having multiple polarities contained within a single magnet and corresponding opposite polarities for the other magnet such that a small lateral displacement or rotation of one magnet with respect to the other removes the various polarities from alignment and allows easy separation of the magnets. If such magnets are incorporated into the shoe shown in FIG. 38, then the shoe may be released by applying the necessary separation motion to the magnets 100. Otherwise, if the magnets 100 are conventional magnets, the magnets 100 may be separated and the shoe released upon applying a sufficient upward foot-removing force.

Figure 39:
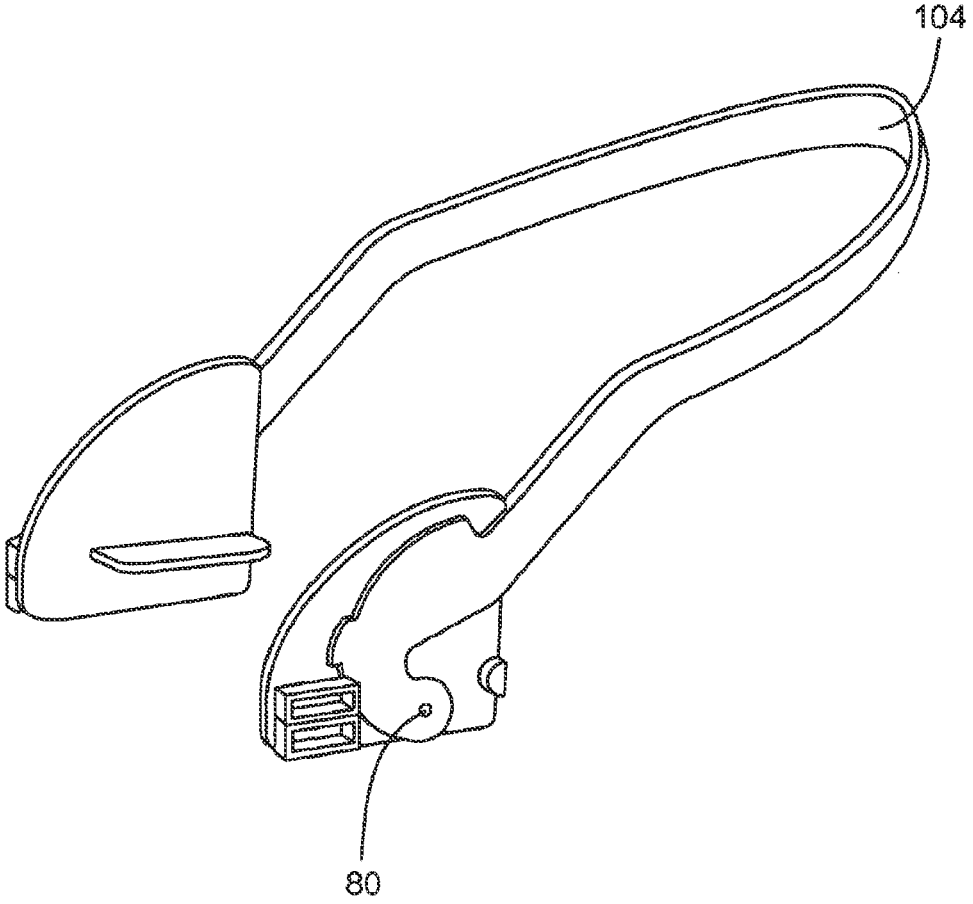
FIGS. 39-44 show perspective views of various shoe components for providing rapid entry into a shoe.

FIGS. 39-44 show perspective views of components for providing rapid entry into a shoe. The embodiment of FIG. 39 utilizes a heel loop 104 attached at a hinged axis of rotation 80. It may utilize one or more springs or elastic elements to cause the heel loop 104 to return to an upward position such as illustrated in FIG. 39.

Figure 40:
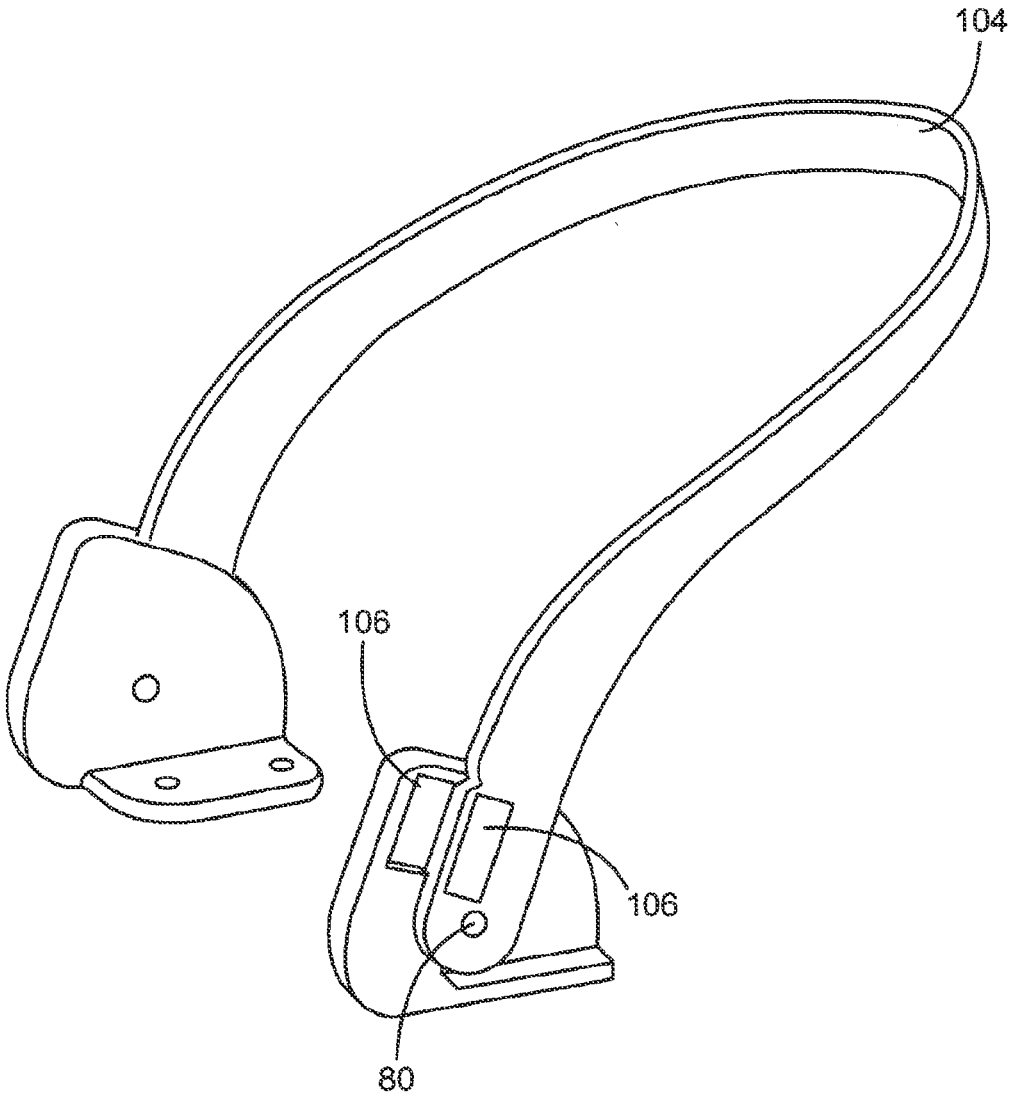
Figure 41:
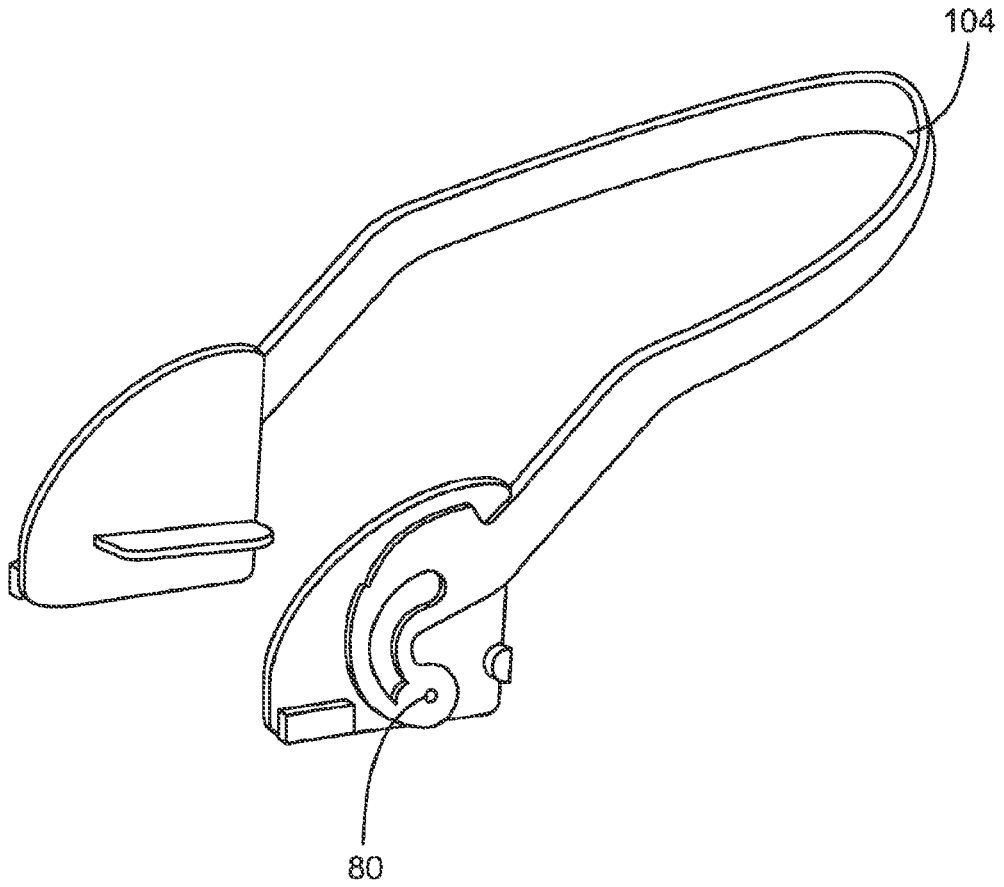

The embodiment of FIG. 40 also utilizes a heel loop 104 attached at a hinged axis of rotation 80. This embodiment, however, utilizes a pair of magnets 106 on each side to assist in returning the heel loop 104 to the upward position illustrated in FIG. 40. Of course, any materials of the shoe surrounding the heel loop 104 may also assist this or any other embodiment to return to a normal closed position. FIG. 41 shows a view of another embodiment having a heel loop 104.

Figure 42:
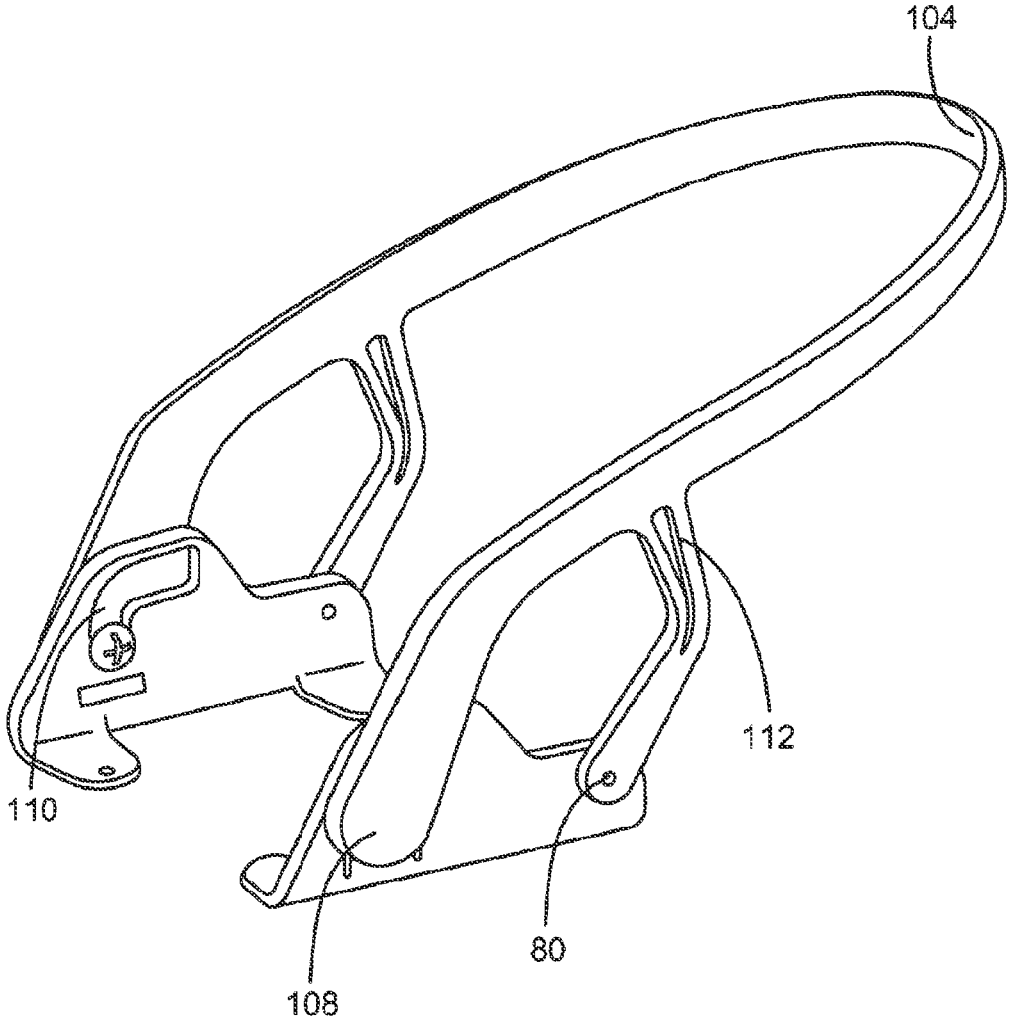

FIG. 42 shows another embodiment having a heel loop 104 attached at a hinged axis of rotation 80. This embodiment, however, has additional features that change the motion of the heel loop 104 as it is pressed downward. The heel loop is attached to forward arms 108 that have protrusions that ride in channels 110. Additionally, the heel loop 104 is connected to the hinged axis of rotation 80 through a semi-flexible portion 112. The combination of features causes the heel loop 104 to initially move more downward and to then transition to moving more backward, as constrained by the channels 110. In at least some shoes, the additional backward motion may provide more room for the user's foot to enter the shoe.

Figure 43:
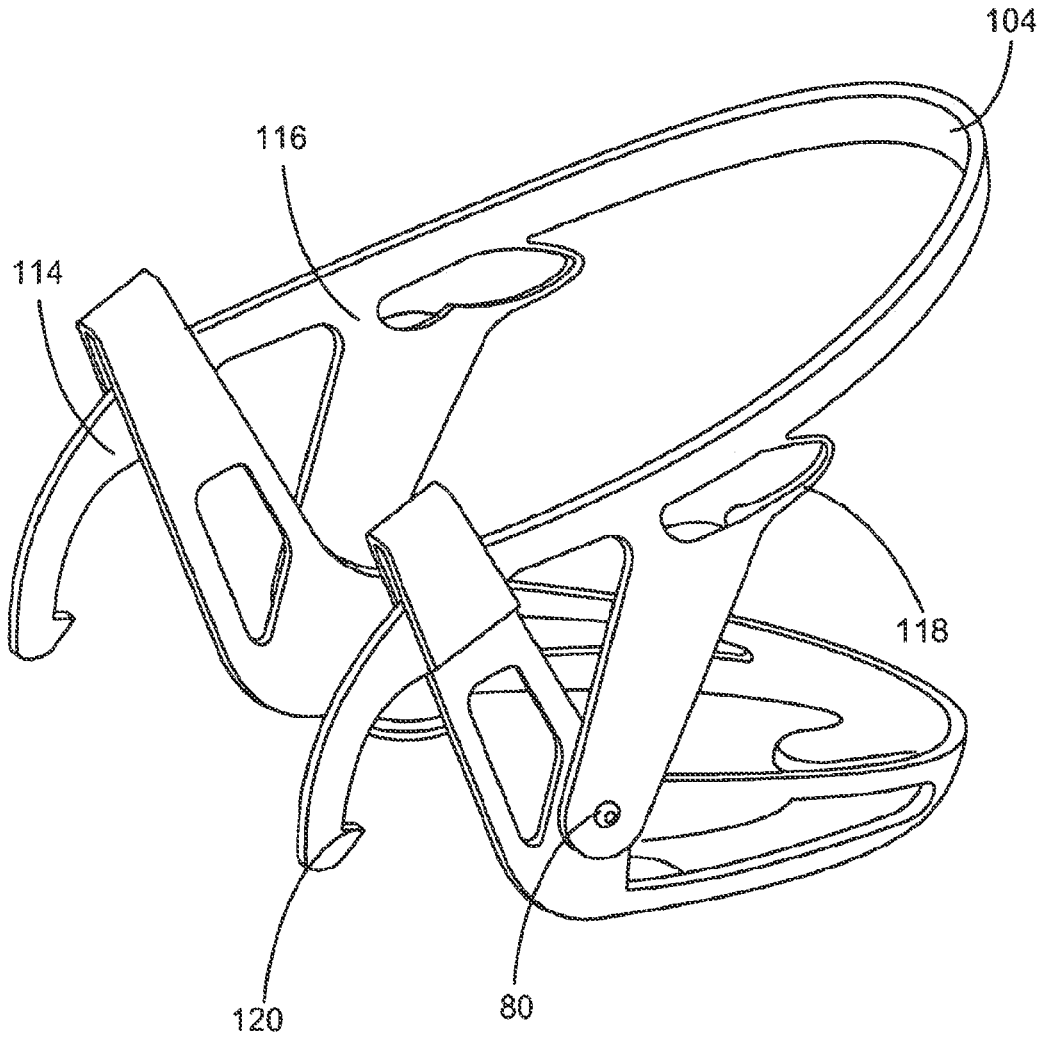

The embodiment of FIG. 43 also has a heel loop 104 attached at a hinged axis of rotation 80, but this version also includes a lock 114 similar to the locks previously discussed. The lock 114 provides additional retention against unwanted rearward release of the heel loop 104. As may be seen in FIG. 43, the location of the axis of rotation 80 is close enough to the lock 114 to make release of the lock 114 difficult or impossible simply by rotating about the axis of rotation 80. Instead, a flexible portion 116 and an integral spring 118 allow the heel loop to move downward without rotating about the axis of rotation until the lock 114 is released. This embodiment includes a stop 120 that prevents motion of the heel loop 104 past a certain point, and reference to the previous Figures will show that some embodiments include similar features even though such features were not specifically discussed with respect to such embodiments.

Figure 44:
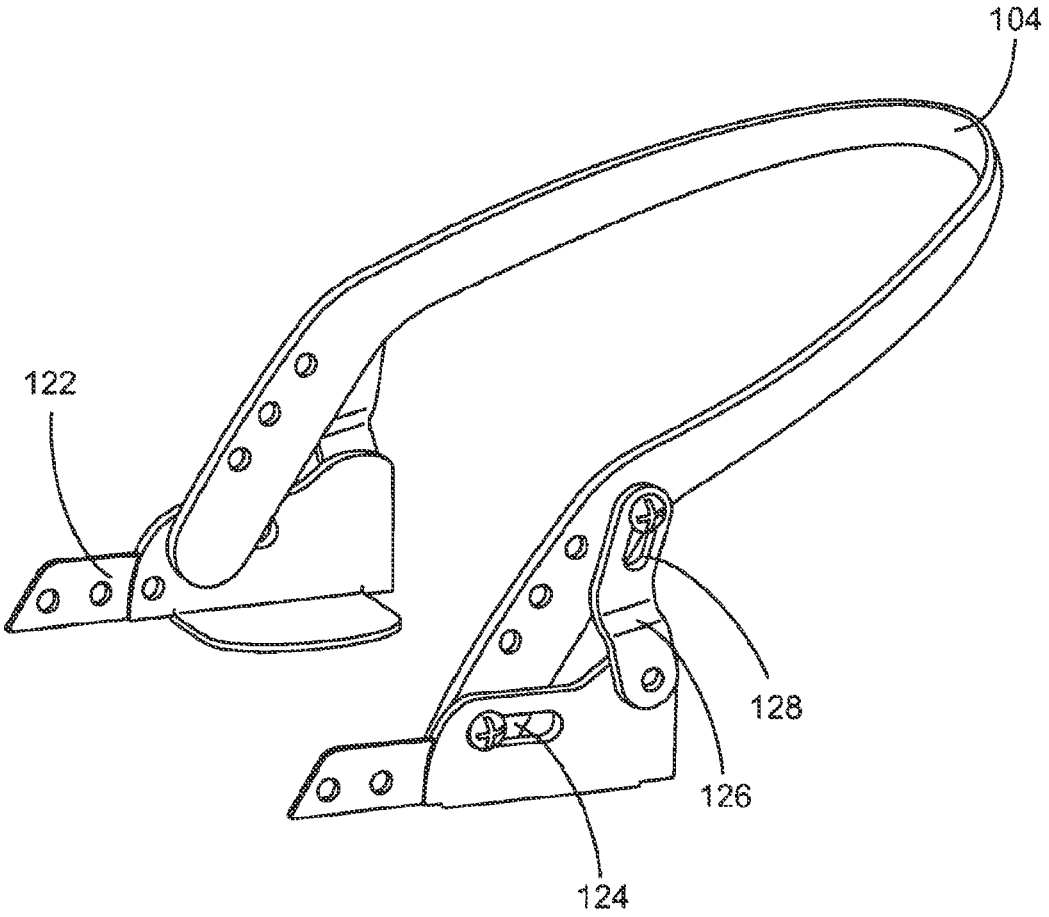

FIG. 44 shows another embodiment having a heel loop 104. This embodiment also includes features not previously discussed that move the heel loop 104 rearward. This embodiment utilizes an anchor element 122 that is anchored to or near a sole of the shoe and has a horizontal channel 124 formed therein that contains a pin of the heel loop 104. Pivotally attached to the anchor element 122 at an upper rear location is a moveable element 126 that has a moveable element channel 128 containing another pin of the heel loop 104. In this embodiment, the pin in the moveable element channel 128 moves downward as the user begins pushing on the heel loop 104, which also moves largely downward but with some rearward motion. As the pin of the heel loop 104 nears the bottom of the moveable element channel 128, the moveable element 126 will have rotated rearward somewhat, but no further downward motion of the heel loop 104 is possible without further rearward rotation of the moveable element 128. Thus, as the heel loop 104 is pressed down further, the pin in the horizontal channel 124 begins moving rearward, and the moveable element 126 also rotates rearward significantly more. This motion imparts additional rearward motion to the heel loop 104, which may assist the user in entering the shoe.

Figure 45:
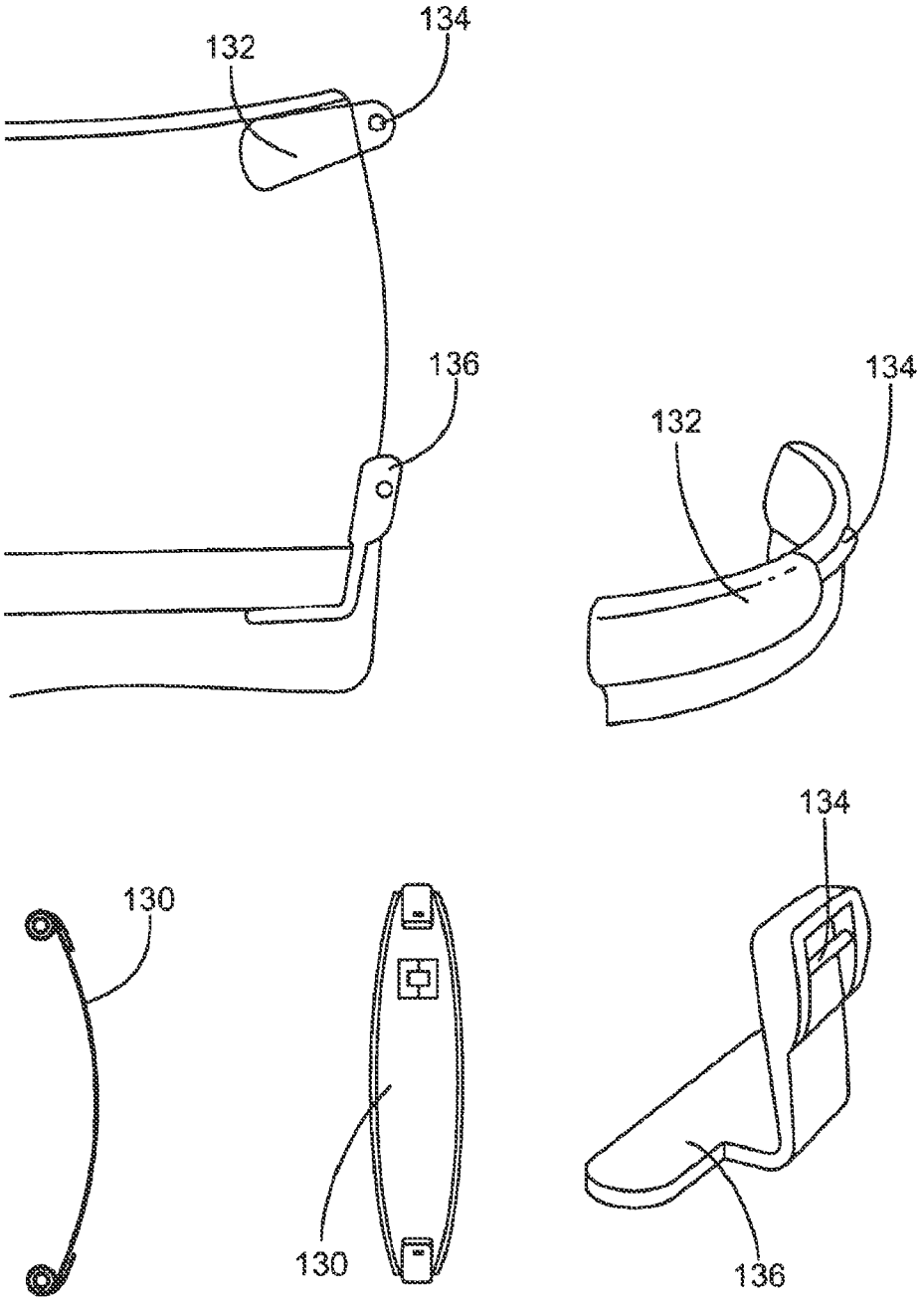
FIG. 45 shows a view of a component for providing rapid entry into a shoe as well as views of various elements making up the component.

FIG. 45 shows a moveable element that utilizes a flat spring 130 to allow the rear of the shoe to be collapsed for entry of a foot, with the spring causing the rear of the shoe to spring back into place. An upper edge of the heel portion of the shoe is provided with an upper support 132. The upper support 132 may be shaped to conform to the rear portion of the user's ankle and includes a spring attachment point 134. Below and at or near the sole of the shoe is a lower support 136 that also has a spring attachment point 134 as shown. The flat spring 130, which may optionally be embellished with decorative elements, is attached between the spring attachment points of the upper support 132 and the lower support 136. The shoe's material between the upper support 132 and the lower support 136 may be made quite flexible such that the shape of the heel portion of the shoe is largely provided by the flat spring 130 and attached upper support 132. The user's foot will readily enter the shoe and the flat spring 130 will ensure that the upper support 132 springs back into place to secure the user's foot.

Figure 46:
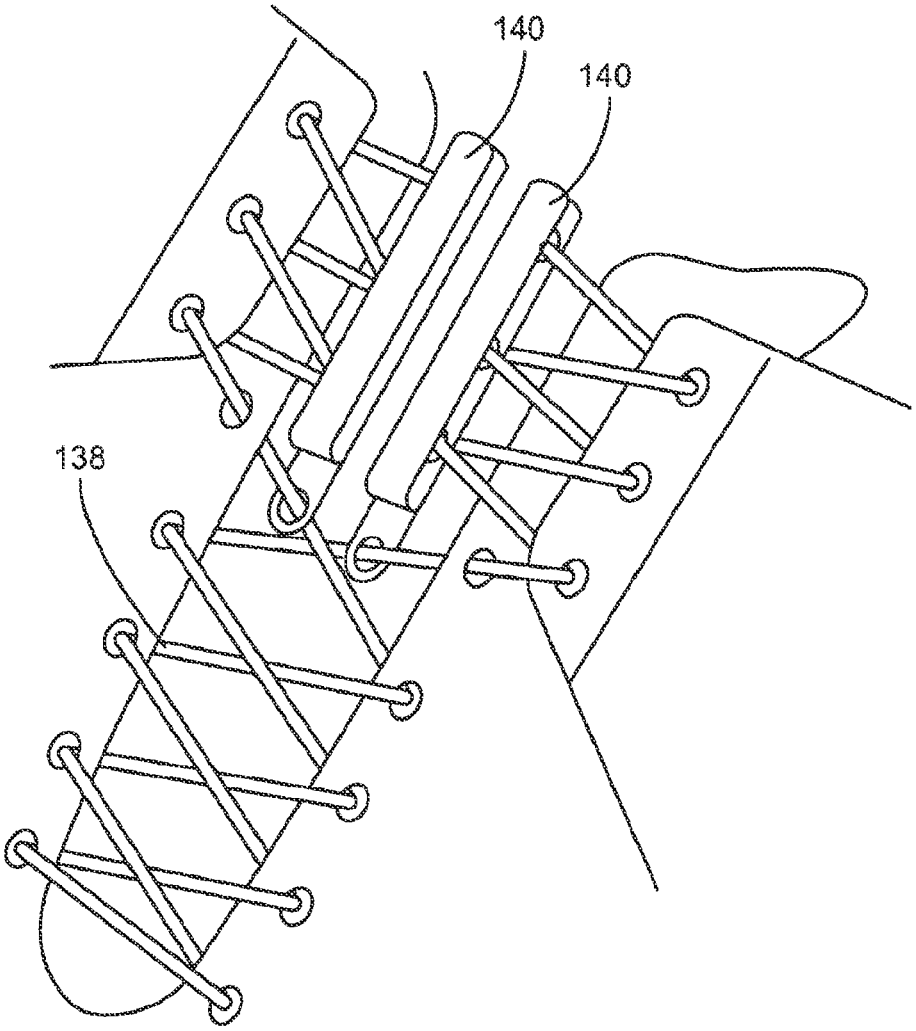
FIG. 46 shows a view of a magnetic system for providing rapid entry into a shoe.

FIG. 46 shows features of a rapid entry shoe where the rapid entry is facilitated by components at the tongue of the shoe. In this embodiment, laces of the shoe, which may essentially be standard laces, are connected to magnets 140 near the top of the tongue. Alternatively, magnets 140 may be attached directly to the tongue and/or another portion of the upper of the shoe near the tongue. The magnets 140 may be correlated magnets as discussed above, whereby separation of the magnets 140 may be readily achieved by relatively-minor rotation or translation of the magnets 140 relative to each other. Although not shown in FIG. 46, a feature may be added to or near to the magnets 140 to facilitate application of the translation or rotation.

Figure 47:
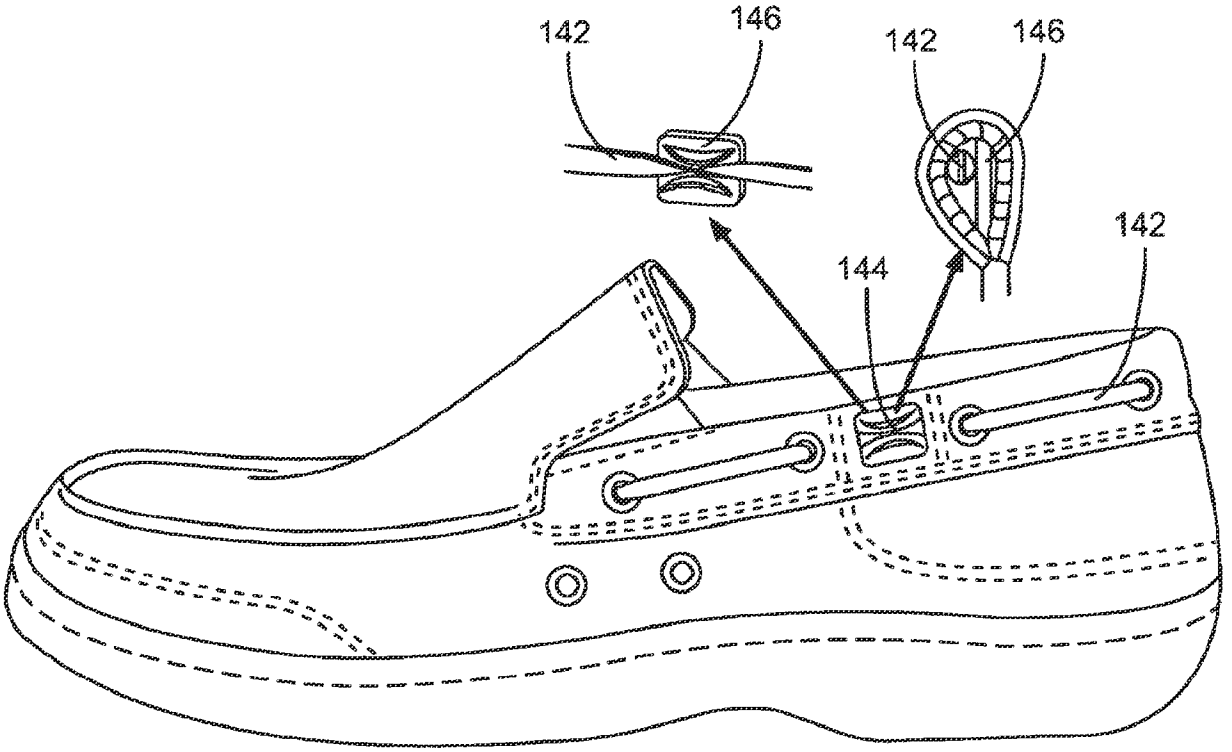
FIG. 47 shows a perspective view of a rapid-entry shoe along with an exploded view of a portion of a rapid-entry component incorporated into the shoe and a cross-sectional view of the portion of the rapid-entry component.

FIG. 47 shows a loafer-type shoe in accordance with embodiments of the invention. The loafer-type shoe resembles standard loafers, with a change in that the normal thin leather strap has been replaced by a flat wire spring 142 of the type commonly used for pop-up tents. If desired, the flat wire spring 142 may be painted, treated, or coated (e.g. with rubber) to have an appearance similar to the normal strap that has been replaced. Through much of its path, the flat wire spring 142 is disposed with a more-vertical orientation that resists vertical bending. However, at a location 144 where the flat wire spring 142 passes behind the material of the loafer, a bend is provided in the flat wire spring 142 such that at the location 144 its orientation is more horizontal and allows vertical bending while simultaneously providing a lifting pressure to the heel portion of the flat wire spring 142. A retaining clip 146 may be used to ensure that the bend remains at location 144 and also may have a flat major surface that is directed inward to the user's foot to better ensure comfort. As should be apparent, a similar bend is provided on the opposite side of the shoe. FIG. 47 includes a pull-out view of the flat wire spring 142 and a cross-sectional view at the location 144.

FIGS. 48-51 show a group of embodiments of flexible tabs 150 that may be incorporated into a shoe to provide rapid entry features as discussed herein. While the flexible tabs 150 may take various shapes and forms, they have several common features. First, the flexible tabs 150 have an axis of rotation 80. As discussed above, placement of the axis of rotation helps control how a rear portion of the shoe will open, whether largely downward or with some or significant amounts of rearward motion. Second, the flexible tabs 150 all have one or more elements that bias the flexible tabs 150 in a way that tends to close the shoe. Third, the flexible tabs 150 are connected to other portions of the shoe so as to permit the forces of the flexible tabs 150 to close the shoe.

Figure 48:
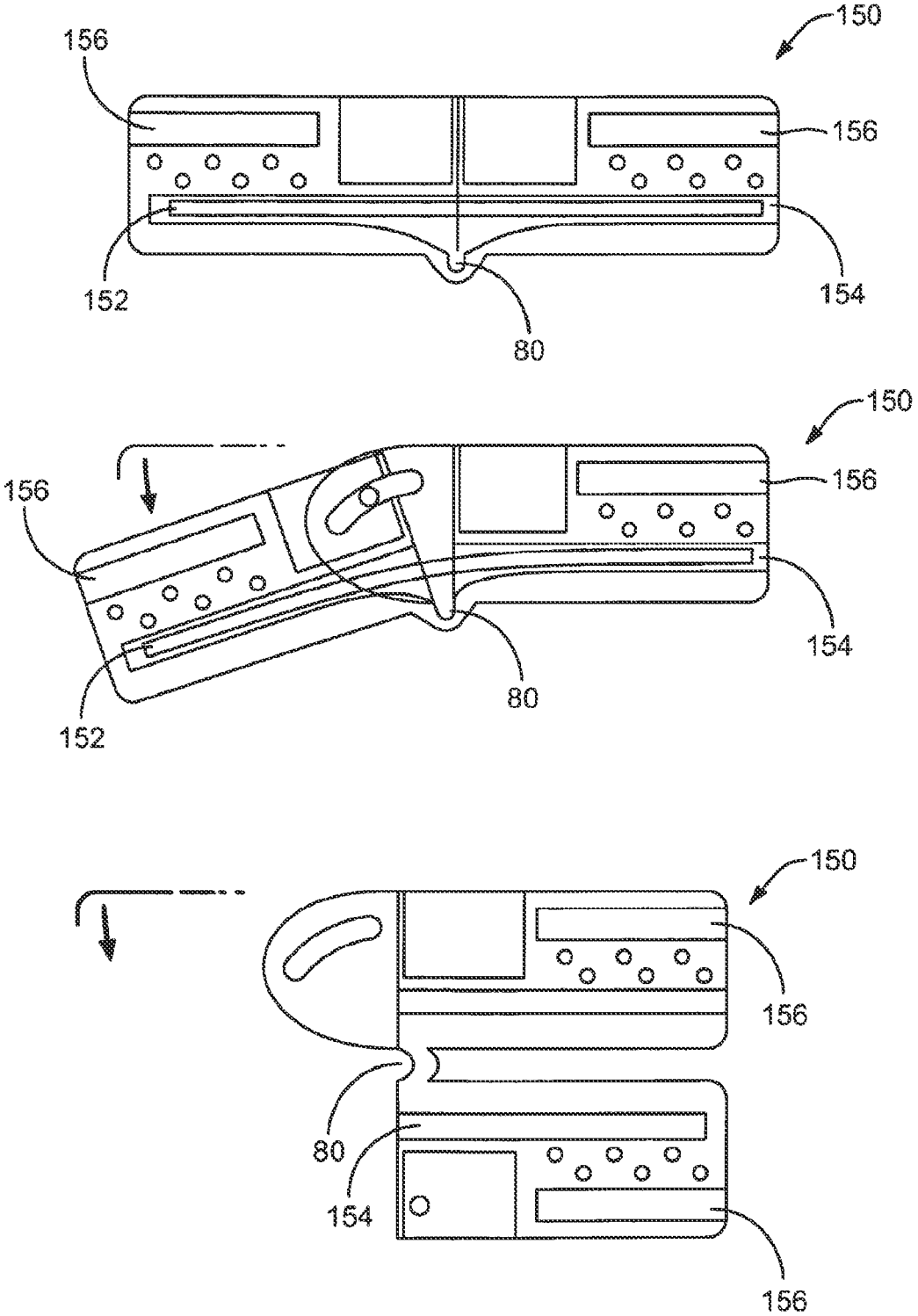
FIGS. 48-51 show views of various types of a rapid entry component and how such components can be incorporated into a rapid-entry shoe.

Thus, for example, FIG. 48 shows one embodiment of a flexible tab 150. This embodiment uses a spring wire 152 in a channel 154 to bias the flexible tab 150 into the uppermost position shown in FIG. 48. The lowermost position shown in FIG. 48 shows how the spring wire 152 may be inserted into the channel 154. The embodiment of FIG. 48 also includes upper channels 156 into which an element corresponding to a heel loop can be inserted such that when such element is pressed downward, the motion is transferred to the flexible tab 150, whereupon the spring wire 152 serves to return the flexible tab 150 to its original position along with the heel portion of the shoe.

Figure 49:
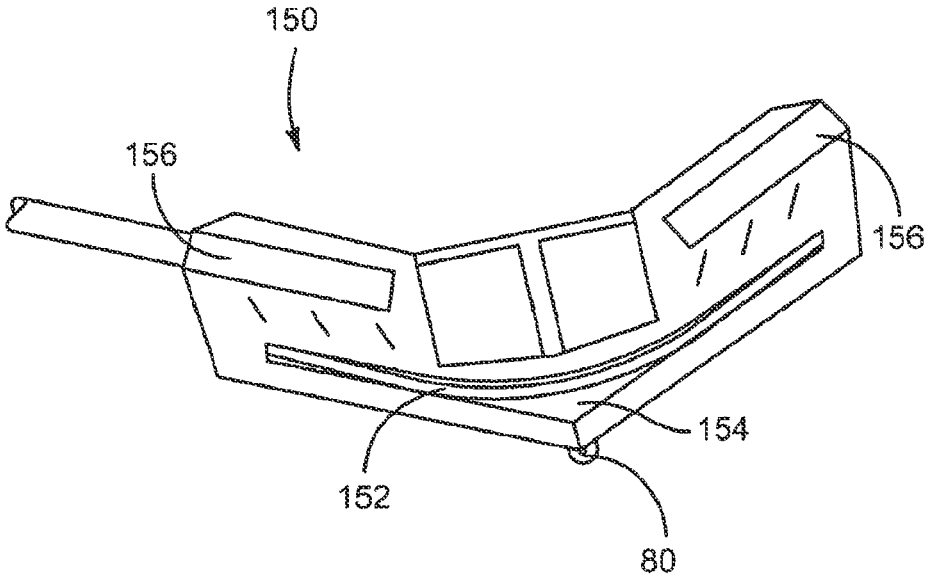
Figure 50:
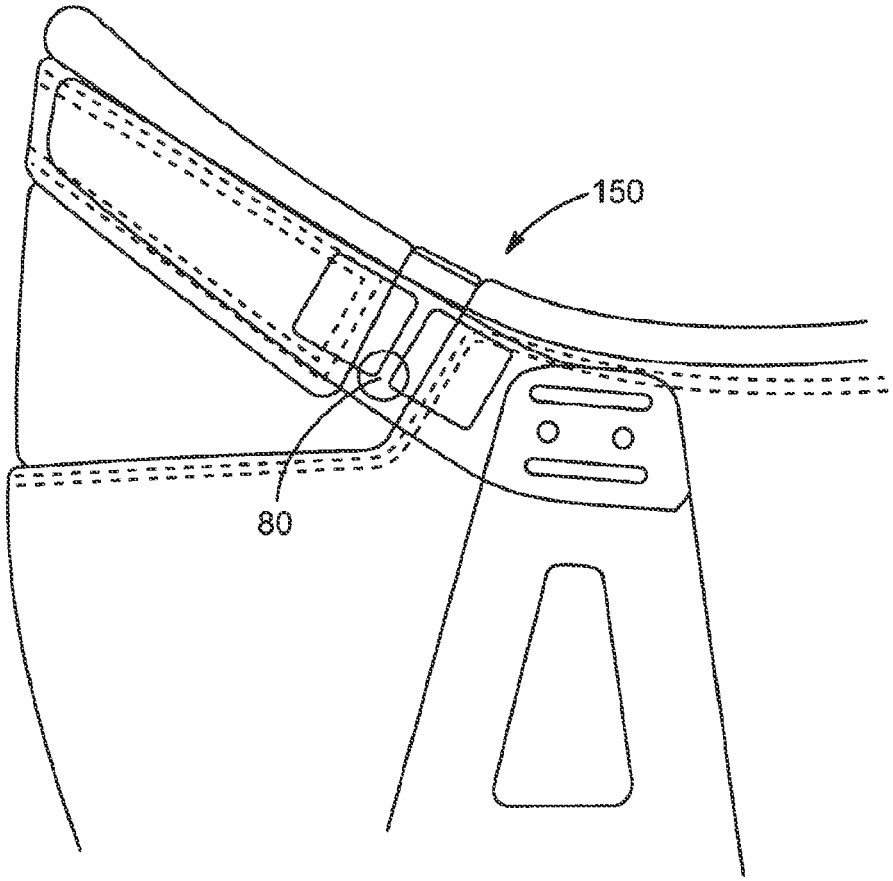
Figure 51:
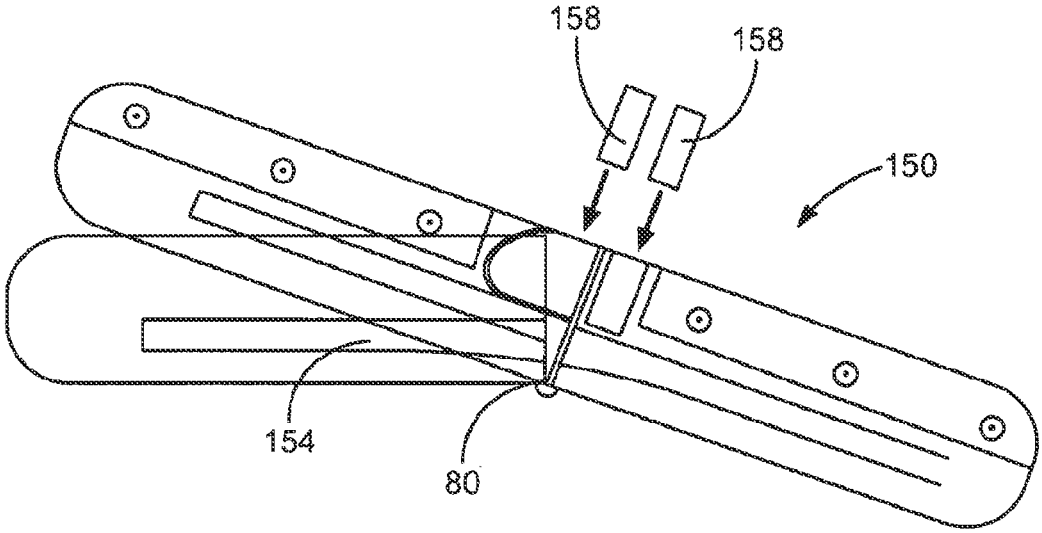

The embodiment of FIG. 49, while having a significantly different shape to accommodate a different shoe structure, has largely similar features, other than that the spring wire 152 is biased into a bent position. In the embodiment of FIG. 50, the upper channels 156 have been omitted in favor of simply extending the flexible tab 150 around the rear of the shoe similar in fashion to the various heel loops discussed previously. The embodiment of FIG. 51 is largely similar, except that magnets 158 have been added to provide additional biasing to keep the flexible tab 150 in a position of a closed shoe.

Figure 52:
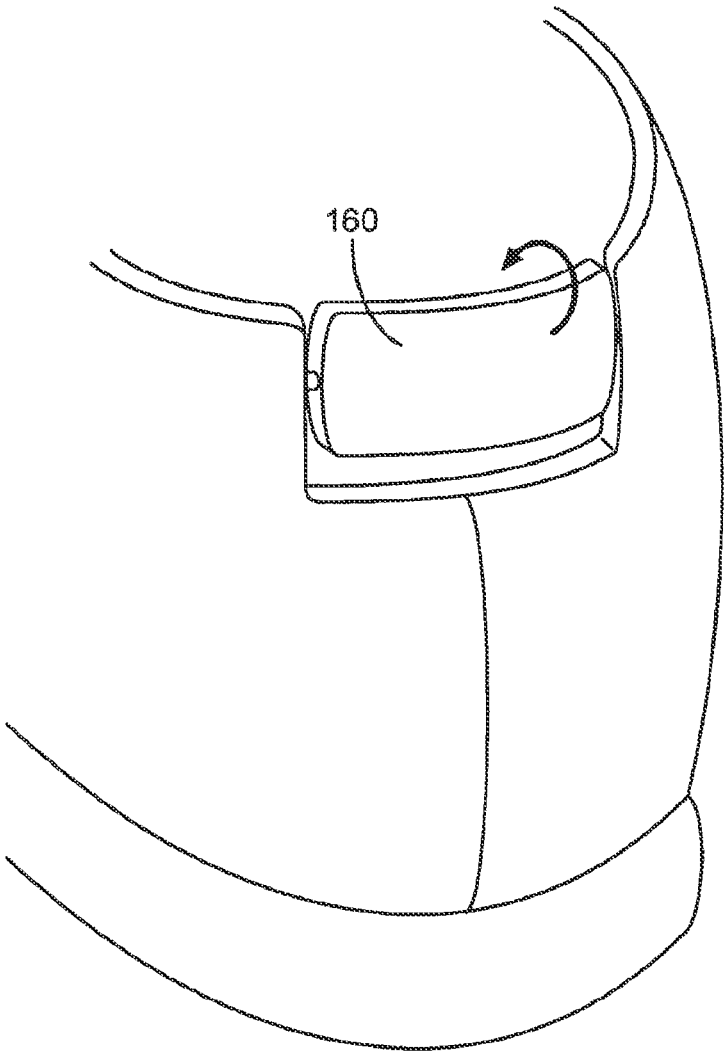
FIG. 52 shows a rear portion of a rapid-entry shoe, illustrating a different type of rapid-entry component.

FIG. 52 shows still another embodiment of a feature providing rapid entry to a shoe. This feature is a flexible rotatable heel strap 160. As the user inserts his or her foot, the flexible rotatable heel strap rotates in the direction shown by the arrow in FIG. 52, allowing the foot to more easily enter, and as the foot comes to rest in the shoe, the flexible rotatable heel strap 160 finishes a 180-degree rotation such that the inner surface of the flexible rotatable heel strap 160 is now the outer surface. The flexible rotatable heel strap 160 is flexible so that it can conform to the user's foot regardless of what surface is outward.

Figure 53:
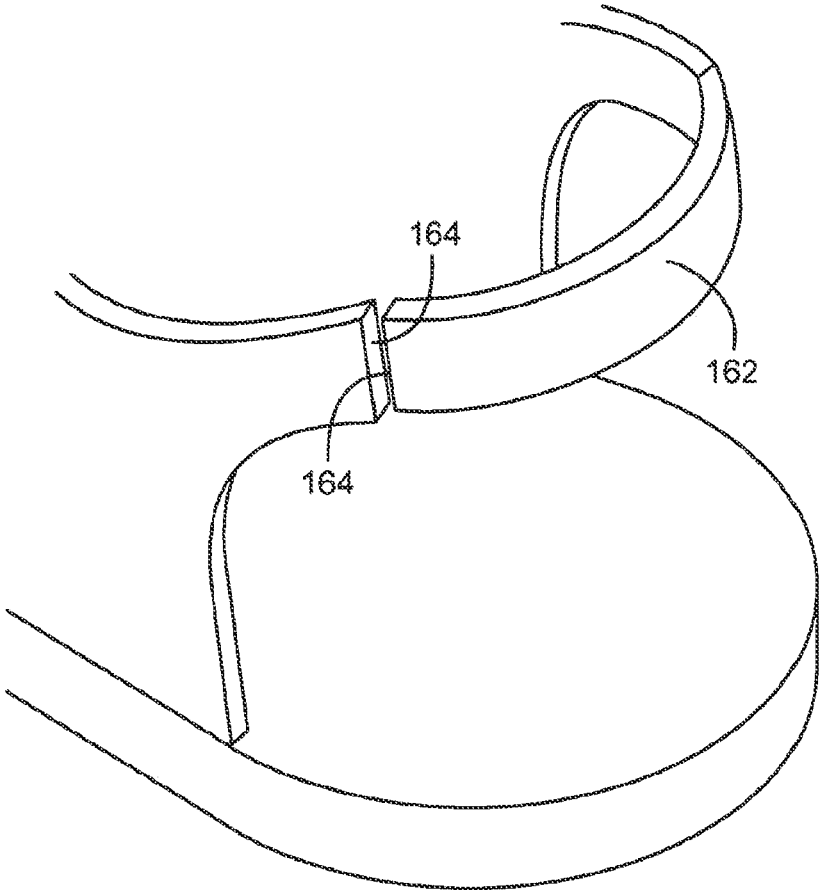
FIG. 53 shows a rear portion of a rapid-entry shoe, illustrating a different type of rapid-entry component.

FIG. 53 shows another embodiment of a rapid entry feature, namely a "breakable" strap 162. This "breakable" strap has an end that can selectively "break" from its normal attachment point, such as by way of separating magnets 164 incorporated into the end and the attachment point. Such magnets 164 may include correlated magnets as discussed herein.

Figure 54:
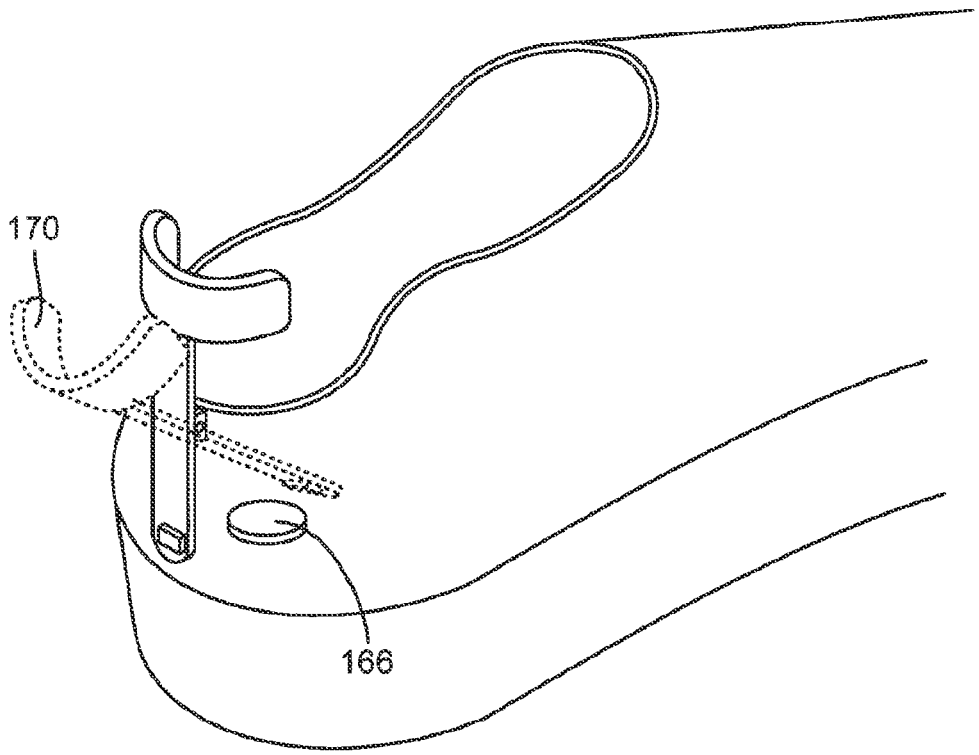
FIG. 54 shows a rear portion of a rapid-entry shoe, illustrating a different type of rapid-entry component.

FIG. 54 shows yet another embodiment of a rapid entry feature, again relying on magnetic forces. This embodiment includes a pivoting element that utilizes magnetic force to provide a snap-to-position feel to use of the feature. The feature relies on a first magnet 166 embedded in the shoe under the heel of the user's foot. A second magnet 168 is attached to a pivoting element 170 in such a way that the first magnet 166 and the second magnet 168 repel each other. The pivoting element 170 is pivotally attached at the rear of the shoe and is able to move between the two positions illustrated in FIG. 54. As the user inserts his or her foot into the shoe, the magnets are forced together against their repelling forces until the second magnet 168 passes by the first magnet 166, at which point the pivoting element 170 "snaps" or "jumps" into an approximately vertical position (stopped in further movement by either a portion of the shoe or by the user's ankle. In this position, the pivoting element 170 serves to retain the shoe on the user. When the user wishes to remove the shoe, the pivoting element 170 is pushed back and "snaps" or "jumps" back into a more-horizontal position ready to receive the user's foot again.

Figure 55:
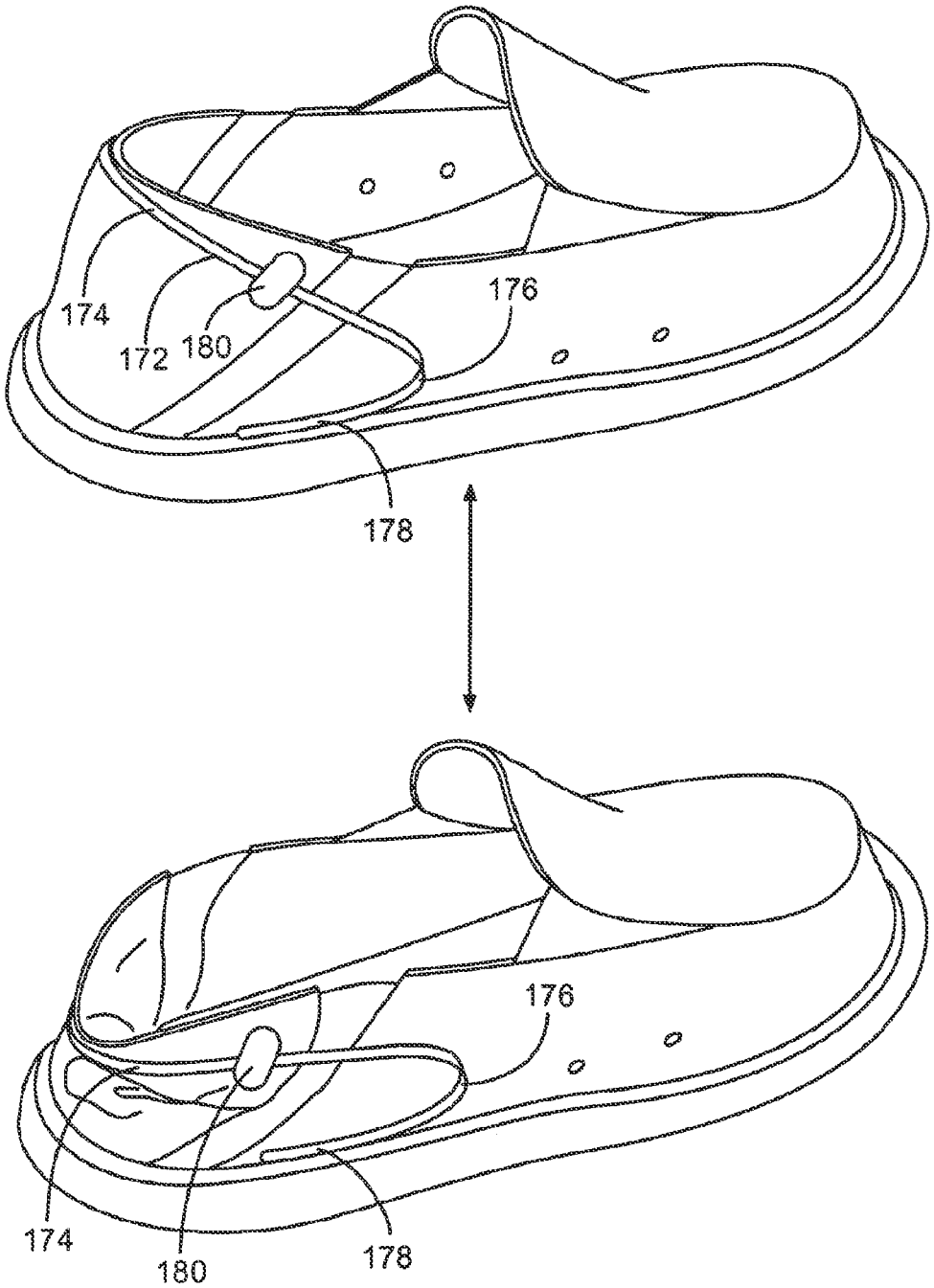
FIG. 55 shows views of an embodiment of a rapid-entry shoe.

FIG. 55 shows another embodiment of a rapid entry shoe utilizing features similar to those discussed with respect to the embodiment illustrated in FIG. 27. This embodiment utilizes a flat metal spring wire 172 (here illustrated on an outside surface of the shoe, but potentially hidden between layers of material of the shoe) to form a heel loop 174. The spring wire 172 normally has its flat surface approximately vertical, so as to provide stiffness against vertical bending and to allow the heel loop 174 to bend to conform to the contours of the user's heel and/or ankle. However, near a front of the spring wire 172, the spring wire 172 is rotated or twisted to have its flat surface approximately normal to the flat surface of the portion forming the heel loop 174. This permits the formation of a bend 176 that allows the heel portion of the shoe to be pushed down to permit rapid entry of the foot as shown in the lower portion of FIG. 55. The ends 176 of the spring wire 172 are secured to or proximate the sole of the shoe, anchoring the spring wire 172.

In at least some embodiments similar to that of FIG. 55, a thin panel 180 or wafer, such as a plastic panel, may be incorporated on sides of the heel area of the shoe. The panel 180 controls the shoe opening while a person steps down on the back of the shoe to insert his or her foot. A top portion of the panel prevents an associated portion of the opening of the shoe from bending inward, as the material below the spring wire 172 naturally bends inward as the back of the shoe collapses and thus forces the panel 180 at least slightly outward. This serves to keep the opening of the shoe more open and facilitates entry of the user's foot into the shoe. In some embodiments, depending on the material of the shoe, the top edge of the shoe opening would tend to roll inward and somewhat block the entrance for the foot into the shoe, making entry more difficult.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

The invention claimed is:

1. A rapid-entry shoe comprising:

a sole support, the sole support comprising an insole having an upper surface configured to support a foot of a user;

an upper coupled to the sole support, the upper defining an opening adapted to receive entry of the foot, the upper comprising a tongue or vamp portion configured to close over the foot of the user; and a connecting band extending from the sole support around at least a portion of the upper and configured to transition the rapid-entry shoe between an open configuration and a closed configuration;

wherein the connecting band is configured to cause the tongue or vamp portion to move approximately in concert with the rear portion of the insole in response to the shoe transitioning between an open position and a closed position;

wherein the connecting bad includes a portion configured to pivot relative to the sole support when transitioning between the open configuration and the closed configuration;

wherein in the open position the rear portion of the insole and the tongue or vamp portion each extend upward significantly above their respective positions when the shoe is in the closed position;

wherein the rear portion of the insole is secured in the closed position against unwanted disengagement to the open position by an engaging element;

wherein no mechanism external to the upper is required to be actuated to achieve wanted disengagement of the rear portion of the insole from the engaging element to the open position;

wherein the rear portion of the insole is released from the closed position and is pivoted upward to the open position by increasing an upward force on the tongue or vamp portion beyond a level normally achieved in using the shoe except when the shoe is desired to be removed;

wherein in response to the user inserting the foot into the opening and pressing down on the insole, the shoe transitions from the open position to the closed position as the rear portion of the insole moves downward while simultaneously the connecting band causes the tongue or vamp portion to close over the foot of the user; and wherein the shoe is biased to the open position by at least one of the insole, and the tongue or vamp portion, and is not biased to the open position by any additional element.

2. The rapid-entry shoe of claim 1, wherein the engaging element is under the rear portion of the insole when the rapid-entry shoe is in the open position.

3. The rapid-entry shoe of claim 2, wherein the engaging element is directly coupled to the rear portion of the insole when the rapid-entry shoe is in the closed position.

4. A rapid-entry shoe comprising:

a sole support, the sole support comprising an insole having an upper surface configured to support a foot of a user;

an upper coupled to the sole support, the upper having a topline defining an opening adapted to receive entry of the foot, the upper comprising a tongue or vamp portion configured to close over the foot of the user;

wherein the shoe has an open position ready to receive the foot and a closed position configured to secure the foot;

wherein in the open position a rear portion of the insole is closer to the topline than when the shoe is in the closed position;

wherein in the open position the rear portion of the insole and the tongue or vamp portion each extend upward significantly above their respective positions when the shoe is in the closed position;

wherein in response to the user inserting the foot into the opening and pressing down on the insole, the shoe transitions from the open position to the closed position as the rear portion of the insole moves downward while simultaneously a connecting band causes the tongue or vamp portion to close over the foot of the user;

wherein the connecting band extends from the sole support around at least a portion of the upper and configured to pivot relative to the sole support when transitioning between the open configuration and the closed configuration;

wherein the rear portion of the insole is secured in the closed position by an engaging element;

wherein no external mechanism is required to be actuated to disengage the rear portion of the insole from the engaging element to the open position;

wherein the rear portion of the insole is disengaged from the closed position and is pivoted upward to the open position by exerting a force on the tongue or vamp portion that is beyond what is normally encountered when wearing the shoe; and wherein the shoe is biased to the open position by at least one of the insole, the tongue or vamp portion, and the connecting band, and is not biased to the open position by any additional element.

5. The rapid-entry shoe of claim 4, wherein the engaging element is under the rear portion of the insole when the rapid-entry shoe is in the open position.

6. The rapid-entry shoe of claim 5, wherein the engaging element is directly coupled to the rear portion of the insole when the rapid-entry shoe is in the closed position.

7. A rapid-entry shoe comprising:

a sole support, the sole support comprising an insole having an upper surface configured to support a foot of a user; and an upper coupled to the sole support, the upper defining an opening adapted to receive entry of the foot;

wherein the shoe further comprises a connecting band extending from beneath a rear portion of the insole and configured to pivot relative to the sole support when transitioning between a closed position and an open position;

wherein in the open position of the shoe the rear portion of the insole and the tongue or vamp portion of the upper each pivot upward significantly above their respective positions when the shoe is in the closed position;

wherein the rear portion of the insole is secured in the closed position by an engaging element;

wherein no external mechanism is required to be actuated to disengage the rear portion of the insole from the engaging element to the open position;

wherein the rear portion of the insole is disengaged from the closed position and is pivoted upward to the open position by exerting a force on the upper that is beyond what is normally encountered when wearing the shoe; and wherein the shoe is biased to the open position by at least one of the insole, the tongue or vamp portion, and the connecting band, and is not biased to the open position by any additional element.

8. The rapid-entry shoe of claim 7, wherein the connecting band is configured to cause the tongue or vamp portion to move approximately in concert with the rear portion of the insole in response to the shoe transitioning between the open position and the closed position.

9. The rapid-entry shoe of claim 8, wherein in response to the user inserting the foot into the opening and pressing down on the insole, the shoe transitions from the open position to the closed position as the rear portion of the insole moves downward while simultaneously the connecting band causes the tongue or vamp portion to close over the foot of the user.

10. The rapid-entry shoe of claim 7, wherein the engaging element is under the rear portion of the insole when the rapid-entry shoe is in the open position.

11. The rapid-entry shoe of claim 10, wherein the engaging element is directly coupled to the rear portion of the insole when the rapid-entry shoe is in the closed position.

* * * * *